US010180013B2

(12) United States Patent
Allen et al.

(10) Patent No.: US 10,180,013 B2
(45) **Date of Patent: *Jan. 15, 2019**

(54) PRIVACY TENT

(71) Applicant: The Board of Trustees of the University of Alabama, Tuscaloosa, AL (US)

(72) Inventors: Jeff Allen, Northport, AL (US); Thomas Patrick Powell, Pelham, AL (US); Jared Porteous, Tuscaloosa, AL (US); Jared Cassity, Tuscaloosa, AL (US); Christian Parris, Birmingham, AL (US)

(73) Assignee: The Board of Trustees of the University of Alabama, Tuscaloosa, AL (US)

( * ) Notice: Subject to any disclaimer, the term of this patent is extended or adjusted under 35 U.S.C. 154(b) by 4 days.

This patent is subject to a terminal disclaimer.

(21) Appl. No.: 15/830,880

(22) Filed: Dec. 4, 2017

(65) Prior Publication Data

US 2018/0087290 A1 Mar. 29, 2018

Related U.S. Application Data

(63) Continuation of application No. 15/263,099, filed on Sep. 12, 2016, now Pat. No. 9,856,672.
(Continued)

(51) Int. Cl.
*E04H 15/38* (2006.01)
*E04H 15/48* (2006.01)

(52) U.S. Cl.
CPC ..... *E04H 15/38* (2013.01); *E04H 15/48* (2013.01)

(58) Field of Classification Search
CPC ..... E04H 15/322; E04H 15/38; E04H 15/48
See application file for complete search history.

(56) References Cited

U.S. PATENT DOCUMENTS 1,819,490 A * 8/1931 Weiss ..... E04H 15/38 135/132
2,856,942 A 10/1958 Scott et al.
(Continued)

FOREIGN PATENT DOCUMENTS

CA 1129754 A1 * 8/1982
EP 1106750 A1 * 6/2001 ..... E04H 3/165
GB 851477 A * 10/1960 ..... E04H 15/38

*Primary Examiner* — David R Dunn
*Assistant Examiner* — Danielle Jackson
(74) *Attorney, Agent, or Firm* — Meunier Carlin & Curfman LLC

(57) ABSTRACT

Various implementations include a fully collapsible and portable tent. For example, in various implementations, the tent includes a frame assembly that includes two or more frame members and two hubs spaced apart from each other. Ends of the frame members are coupled to the hubs. At least one of the frame members is pivotably coupled to the hubs via pivotable brackets. The pivotably coupled frame member pivot about a first axis extending through each end of the pivotably coupled frame member and the respective pivotable bracket, and the pivotable brackets pivot about a second axis extending through the pivotable bracket and the respective hub, wherein the first axis is spaced apart from the first axis. The pivotable brackets allow the tent to be moved between the collapsed and expanded positions quickly and with minimal effort.

23 Claims, 23 Drawing Sheets

Related U.S. Application Data

(60) Provisional application No. 62/217,408, filed on Sep. 11, 2015.

(56) References Cited

U.S. PATENT DOCUMENTS

| | | | | |
|---|---|---|---|---|
| 2,864,388 | A | 12/1958 | Oliver et al. | |
| 2,969,075 | A | 1/1961 | Girten et al. | |
| 3,171,417 | A | 3/1965 | Stokes et al. | |
| 3,513,861 | A | 5/1970 | Johnson | |
| 3,906,968 | A * | 9/1975 | Black | E04H 15/38 135/132 |
| 4,355,650 | A | 10/1982 | Beaudry et al. | |
| 5,655,559 | A * | 8/1997 | Zembik | E04H 15/38 135/132 |
| 5,740,826 | A * | 4/1998 | Nevin | E04H 6/04 135/133 |
| 6,209,558 | B1 | 4/2001 | Viglione et al. | |
| 7,051,481 | B2 * | 5/2006 | Delavega | E04H 6/04 135/133 |
| 7,475,700 | B2 * | 1/2009 | Pollard | E04H 15/38 135/132 |
| 8,079,380 | B2 | 12/2011 | Ruppel et al. | |
| 8,555,909 | B2 * | 10/2013 | Chen | E04H 15/38 135/130 |
| 9,567,767 | B2 * | 2/2017 | Kendrick | E04H 15/34 |
| 9,856,672 | B2 * | 1/2018 | Allen | E04H 15/48 |
| 2005/0155299 | A1 * | 7/2005 | Alspaugh | E04H 15/38 52/79.1 |
| 2006/0054208 | A1 | 3/2006 | Romano et al. | |
| 2011/0146737 | A1 | 6/2011 | Friedman et al. | |
| 2015/0368926 | A1 | 12/2015 | Herrera et al. | |
| 2016/0362906 | A1 | 12/2016 | Dieter et al. | |

* cited by examiner

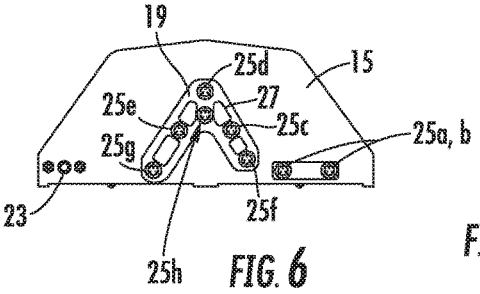
FIG. 6
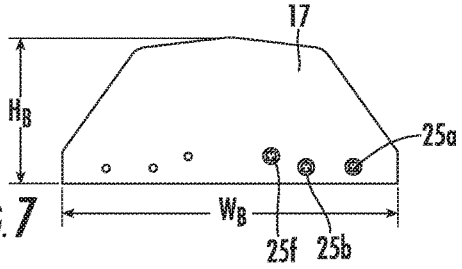
FIG. 7
FIG. 8
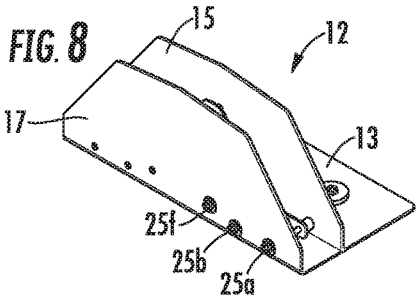
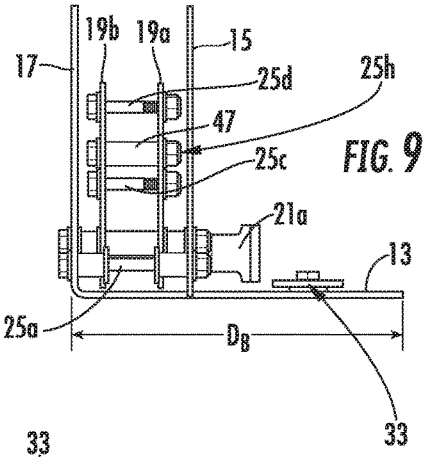
FIG. 9
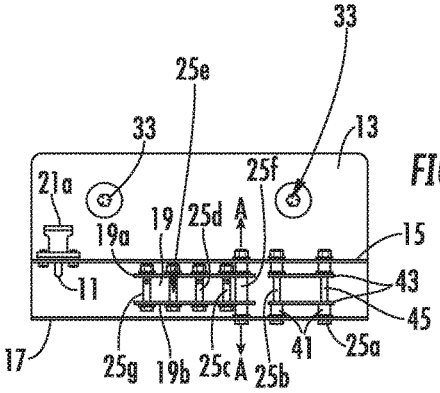
FIG. 10

PRIVACY TENT

CROSS REFERENCE TO RELATED APPLICATIONS

This application is a continuation of application Ser. No. 15/263,099, filed Sep. 12, 2016, which claims priority to U.S. Provisional Patent Application No. 62/217,408, entitled "Privacy Tent," filed Sep. 11, 2015, both of which are herein incorporated by reference in their entirety.

BACKGROUND

On-field privacy for injured players is either non-existent or provided in a limited capacity by the sports medicine staff or others holding towels near the injured players to obscure the view of the injured players, which may compromise medical confidentiality. Thus, on-field treatment leaves the player in full or partial view of media, fans, and the opposing team. In addition, medical personnel may be distracted during the evaluation due to the lack of privacy. Accordingly, there is a need for providing privacy to players and medical personnel during medical evaluations.

BRIEF SUMMARY

Various implementations include a tent frame assembly that includes a first hub, a second hub and at least one a first frame member and a second frame member. The second hub is separate and spaced apart from the first hub. Each frame member has a first end and a second end. The first ends of the frame members are coupled to the first hub, and the second ends of the frame members are coupled to the second hub. The first end and the second end of at least the second frame member are pivotably coupled to the hub. The second frame member is pivotable relative to the first and second hubs between an extended position in which the second frame member is spaced apart from the first frame member and a collapsed position in which the frame members are stacked adjacent each other.

In some implementations, a cover is coupled to the frame members.

In some implementations, each hub comprises a pivotable bracket. The pivotable bracket for each hub couples the first end of the second frame member to the first hub and the second end of the second frame member to the second hub.

In some implementations, the tent frame assembly also includes a third frame member, a fourth frame member, and a fifth frame member. The third, fourth, and fifth frame members each have a first end coupled to the pivotable bracket of the first hub and a second end coupled to the pivotable bracket of the second hub. In the extended position, adjacent frame members are expanded to be disposed between 30° and 60° away from each other. In addition, in some implementations, the first end of the first frame member is statically coupled to the first hub, and the second end of the first frame member is statically coupled to the second hub.

In some implementations, the pivotable bracket includes a first V-shaped plate and a second V-shaped plate. The V-shaped plates are spaced apart, and each plate defines openings that align with corresponding openings in the other plate and with a corresponding opening defined through each of the second, third, fourth, and fifth frame members. Each of the second, third, fourth, and fifth frame members is pivotably coupled between the V-shaped plates via a frame member fastener, and each frame member fastener extends through the corresponding aligned openings in the plates and the respective frame member. The respective frame members are pivotable about the respective frame member fastener. And, the pivotable bracket is pivotably coupled to the respective hub via a bracket fastener and pivots about the bracket fastener.

In some implementations, at least one of the second, third, fourth, or fifth frame members defines a pin opening and at least one of the hubs defines a pin opening. The tent frame assembly further includes a removable pin. The pin opening in each frame member and the corresponding pin opening in the hub are aligned in the expanded position, and a removable pin is engageable through the aligned pin openings to prevent the frame members from pivoting relative to the hub.

In some implementations, each V-shaped plate includes a first end that defines an opening for the bracket fastener and a second end. The pivotable bracket further includes a tab that extends between lower surfaces of the second ends of the V-shaped plates. The tab is adjacent the fifth frame member in the expanded position.

In some implementations, each hub defines a pin opening spaced above a portion of the hub that is adjacent the fifth frame member in the expanded position. A removable pin is engagable through the pin opening and above the fifth frame member in the expanded position. The fifth frame member is statically disposed between the removable pin and the tab in the expanded position to prevent the pivotable bracket from pivoting relative to the hub.

In some implementations, each frame member includes a first end support, a second end support, a first central support, and a second central support. The first end support includes the first end of each frame member at a proximal end thereof, and the second end support includes the second end of each frame member at a proximal end thereof. Each of the first end support and the second end support have a distal end. A first central plate is coupled to a first end of the first central support, and a second central plate is coupled to a first end of the second central support. The first and second central plates are hingedly coupled to each other. A first end plate is hingedly coupled to a second end of the first central support and is statically coupled to the distal end of the first end support. And, a second end plate is hingedly coupled to a second end of the second central support and is statically coupled to the distal end of the second end support. In a folded position, the central supports and the end supports are stacked adjacent each other, and in an unfolded position, the central supports extend away from each other and the end supports.

In some implementations, the central supports pivot upwardly about the central plates and downwardly about the end plates in the folded position.

In some implementations, the tent frame assembly includes a third frame member and a fourth frame member. The third frame member is pivotably coupled to the first and second hubs, and the fourth frame member is pivotably coupled to one of the first, second, or third frame members.

In some implementations, each hub includes first and second vertical plates that are spaced apart from each other and wear pads coupled to facing surfaces of the vertical plates. A portion of the second frame member is disposed between the wear pads coupled to each hub, and the ends of the second frame member pivot between the expanded position and the collapsed position between the wear pads.

In some implementations, the frame members and the cover define an interior volume in the expanded position for housing, wherein the interior volume has a height, width, and length, and wherein each of the height, width, and length is a minimum of sixty inches.

In some implementations, each frame member has a first end support and a second end support. The first end is a proximal end of the first end support, and the second end is a proximal end of the second end support. Each of the first end support and the second end support include a first telescoping segment and a second telescoping segment. The first telescoping segment slides within the second telescoping segment between a shortened position and an elongated position.

In various implementations, a tent assembly includes one or more collapsible frame members, and each frame member has a first end and a second end. The tent assembly also includes a cover coupled to at least one of the frame members and at least one wheel coupled adjacent to the first end and second end of the frame members. The wheels allow the tent assembly to be moved along the ground in an expanded or collapsed position.

In some implementations, the tent assembly further includes a first hub and a second hub. The first and second ends of at least one collapsible frame member are pivotably coupled to the first and second hubs, respectively.

In some implementations, the at least one wheel includes a first wheel coupled to the first hub and a second wheel coupled to the second hub.

In some implementations, the tent assembly defines an interior volume in the expanded position, wherein the interior volume has a height, width, and length, and wherein each of the height, width, and length is a minimum of sixty inches.

BRIEF DESCRIPTION OF THE DRAWINGS

FIG. 6 is a side view of plate 15 of hub 12 shown in FIG. 5 without the frame members coupled to the hub 12.

FIG. 7 is a side view of plate 17 of hub 12 shown in FIG. 5 without the frame members coupled to the hub 12.

FIG. 8 is a perspective view of the hub 12 shown in FIG. 5.

FIG. 9 is an end view of a first side 28 of hub 12 shown in FIG. 5 without the frame members coupled to the hub 12.

FIG. 10 is a top view of the hub 12 shown in FIG. 5 without the frame members coupled to the hub 12.

DETAILED DESCRIPTION

Various implementations include a fully collapsible and portable tent for providing privacy. For example, an injured athletic player may be brought into the tent for private on-field injury treatment. The tent includes a collapsible frame that can be moved on and off the field (e.g., along the sidelines or the playing area of the field) to provide full privacy for both the player and the treating medical staff. In addition, some implementations may provide a barrier from the elements, such as rain or wind, which allow the medical staff to assist the player without these distractions. Once the player is treated, the tent can easily be collapsed. Furthermore, in the collapsed position, the tent does not obstruct the view of spectators and may be stored on the sidelines to avoid interfering with the game.

For example, in various implementations, the tent includes a frame assembly that includes two or more frame members and two hubs spaced apart from each other. Ends of the frame members are coupled to the hubs. At least one of the frame members is pivotably coupled to the hubs via pivotable brackets. The pivotably coupled frame member pivot about a first axis extending through each end of the pivotably coupled frame member and the respective pivotable bracket, and the pivotable brackets pivot about a second axis extending through the pivotable bracket and the respective hub, wherein the first axis is spaced apart from the first axis. The pivotable brackets allow the tent to be moved between the collapsed and expanded positions quickly and with minimal effort.

Figure 1:
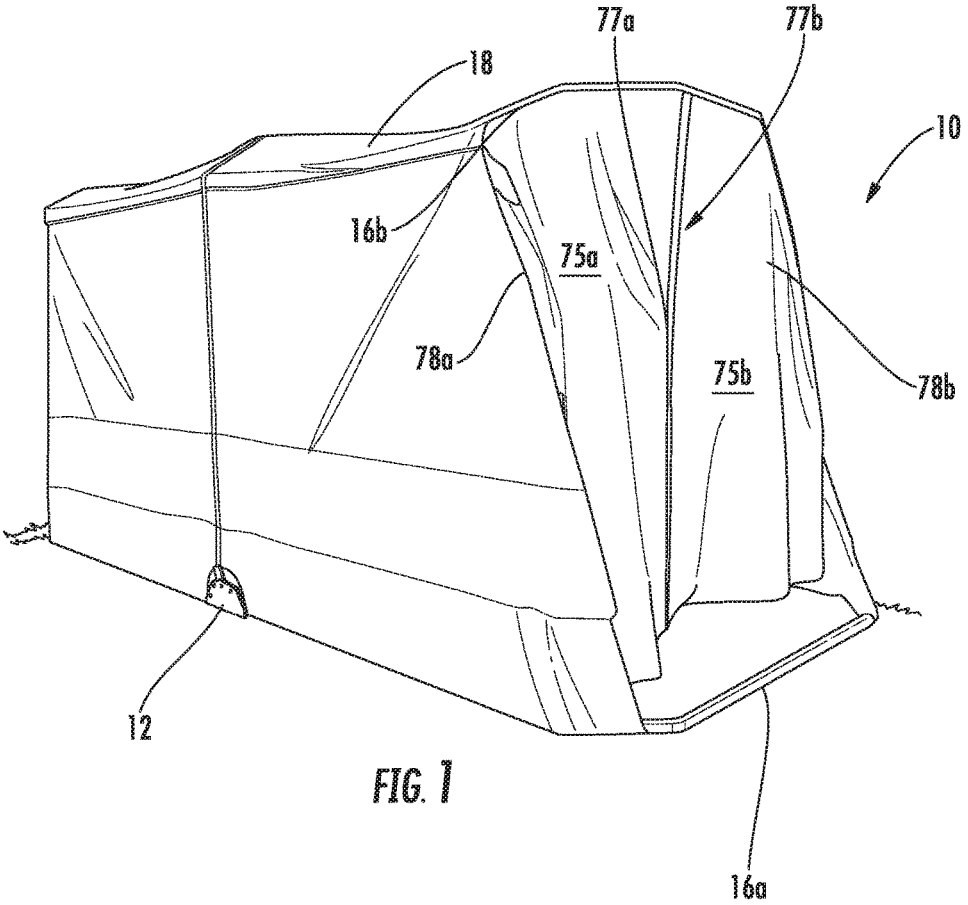
FIG. 1 is a perspective view of a tent assembly in its expanded position according to one implementation.
Figure 2:
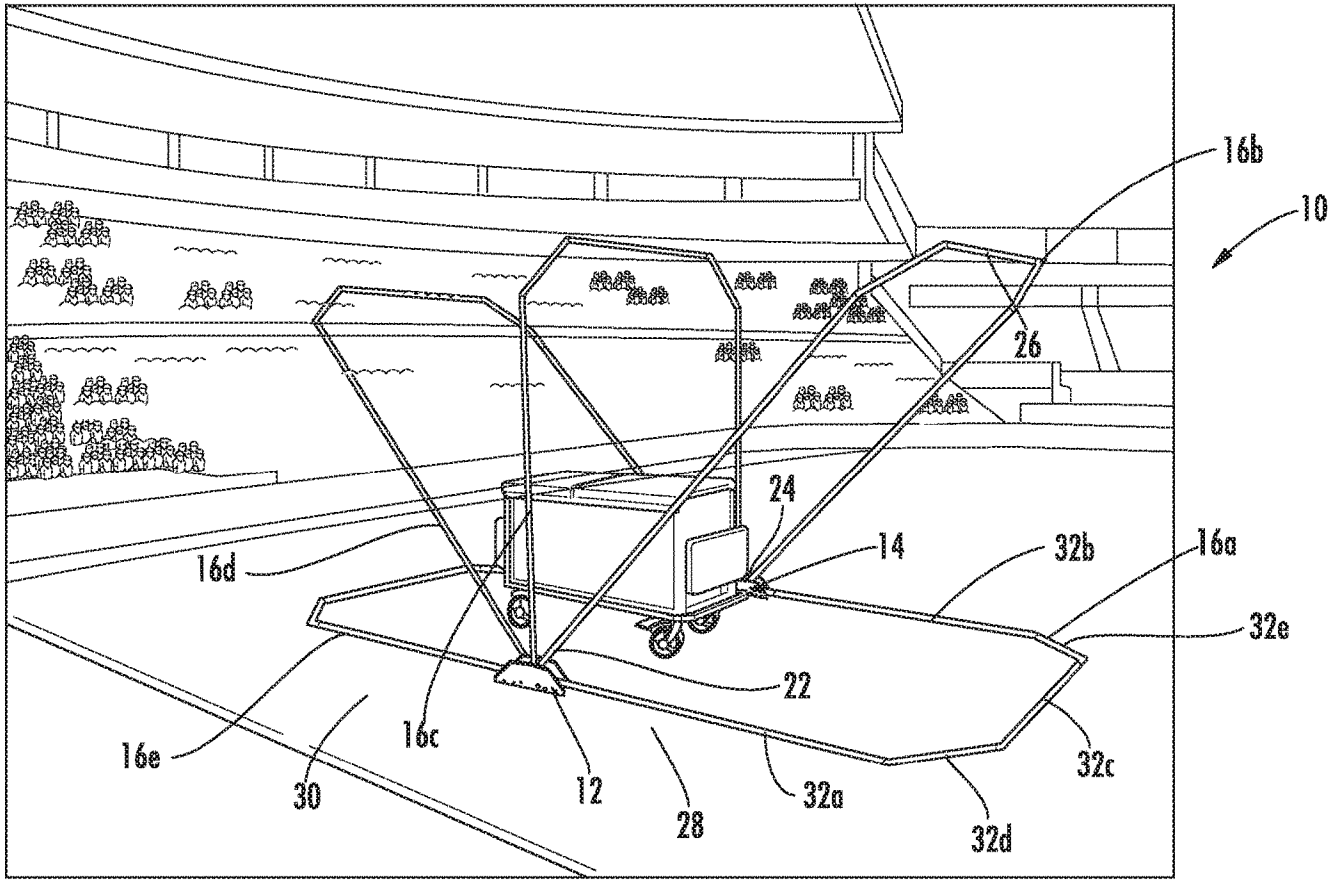
FIG. 2 is a perspective view of the tent assembly of FIG. 1 without a cover coupled to frame members.
Figure 3:
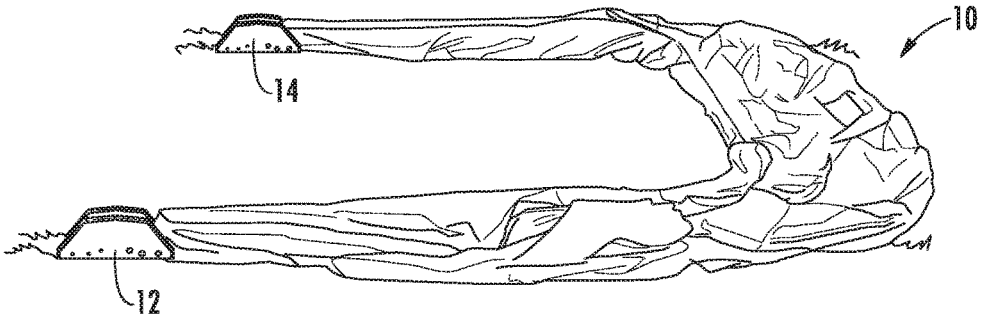
FIG. 3 is a perspective view of the tent assembly of FIG. 1 with the cover coupled to the frame members and in the collapsed position.
Figure 4:
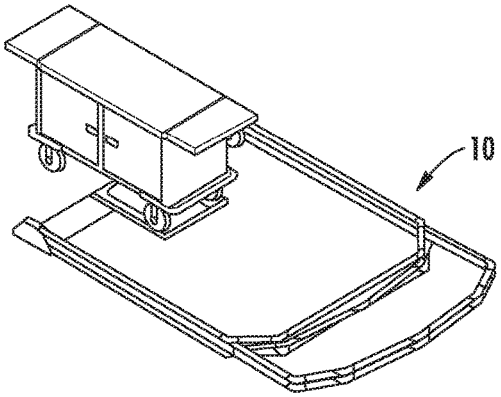
FIG. 4 is a perspective view of the tent assembly of FIG. 1 without the cover coupled to the frame members and in the collapsed position.

FIGS. 1 through 3 illustrate a tent assembly according to one implementation. The tent assembly 10 includes a first hub 12, a second hub 14, a plurality of frame members 16*a*, 16*b*, 16*c*, 16*d*, and 16*e*, and a cover 18. The first hub 12 and second hub 14 are spaced apart from each other. Each frame member 16*b*-16*e* comprises a first end portion 22 and a second end portion 24 and an intermediate portion 26 extending between the first end portion 22 and the second end portion 24. The first end portion 22 of each frame member 16*b*-16*e* is pivotably coupled to the first hub 12, and the second end portion 24 of each frame member 16*b*-16*e* is pivotably coupled to the second hub 14. First end portion 22 and second end portion 24 of stationary frame member 16*a* are coupled to hubs 12, 14, respectively, adjacent the first end 28 of each hub 12, 14 and are stationary with respect to the hubs 12, 14.

The frame members 16*a*-16*e* may be formed of polyvinyl chloride (PVC), aluminum, carbon fiber, lightweight alloys, steel, or other suitable material that allows the tent to be collapsed and extended and moved onto and off of the field easily in either position and provide sufficient support to the cover 18 in the expanded position.

In addition, each of the frame members 16*a*-16*e* shown in FIGS. 1 through 3 has two radial (or end) supports 32*a*, 32*b* and a cross support 32*c*. A diagonal support 32*d*, 32*e* extends between each distal end of the radial supports 32*a*, 32*b* and respective ends of the cross support 32*c*. In addition, the length of each pair of radial supports 32*a*, 32*b* for frame members 16*a*-16*e* may be the same or differ. For example, the length of the radial supports for frame members 16*a*, 16*e* may be less than the length of the radial supports for frame members 16*b*-16*d*.

In other implementations, each frame member 16*a*-16*e* may include any number of supports to form various types of shaped openings relative to the hubs 12, 14. For example, each frame member may include one support that forms an arch shape between the two hubs 12, 14, two supports that extend from the hubs 12, 14 toward each other to form an apex, or triangular shaped opening, or three supports that extend from the hubs 12, 14 to form a trapezoidal or rectangular shaped opening. And, as discussed below in relation to FIGS. 20A-20F, frame members 16*a*'-16*e*' include four supports that are hingedly coupled together to allow the frame members to move between a folded configuration and an unfolded configuration.

In the extended position shown in FIG. 2, frame member 16*a* lies on the ground adjacent a first side 28 of the hubs 12, 14, and frame member 16*e* is pivoted to lie on the ground adjacent a second, opposite side 30 of the hubs 12, 14. Frame member 16*b* is pivoted to extend between 30° and 60° (e.g., 45° to 50°) above the ground relative to the first side 28 of the hubs 12, 14. Frame member 16*c* is pivoted to extend 90° relative to the ground above the hubs 12, 14. And, frame member 16*d* is pivoted to extend between 30° and 60° (e.g., 45° to 50°) above the ground relative to the second side 30 of the hubs 12, 14. In other implementations, the angles at which the frame members are disposed relative to the ground in the extended position may vary. For example, in an implementation in which there are four frame members, two frame members may lie on the ground on either side of the hubs 12, 14, and two other frame members may extend at a 60° angle relative to the ground.

To prevent adjacent frame members 16*a*-16*e* from pivoting more than a predetermined angle apart from each other when pivoted into the expanded position, two or more adjacent frame members may be coupled together. For example, in the implementation shown in FIGS. 1-10, the frame members are coupled together and to hubs 12, 14 via a pivotable bracket 19.

Figure 5:
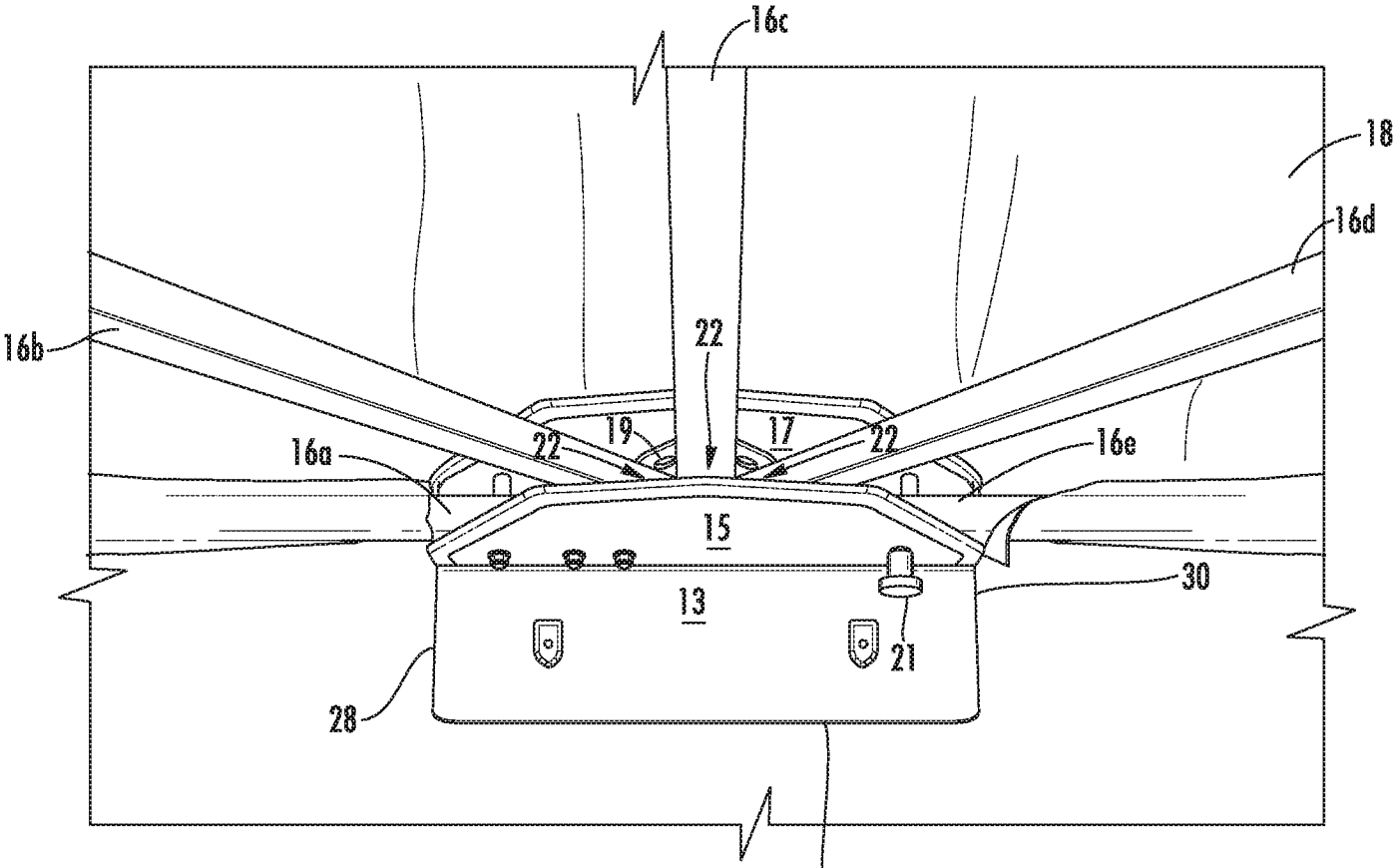
FIG. 5 is a partial perspective view of hub 12 shown in FIG. 1 with frame members coupled to the hub 12.

FIGS. 5 through 12 illustrates various views of the tent 10, hubs 12, 14, and the bracket 19. FIG. 5 illustrates hub 12. It should be understood that hub 14 is a mirror image of hub 12 and does not need to be described separately. As shown in FIG. 5, hub 12 includes a base plate 13, an outer vertical plate 17, and an inner vertical plate 15. Vertical plate 17 extends upwardly from adjacent an outer edge of the base plate 13, and vertical plate 15 extends upwardly from a portion of the base plate 13 spaced apart from the outer vertical plate 17 and inwardly from the outer edge. A bracket 19 is pivotably coupled to and disposed between the vertical plates 15, 17. First end portions 22 of frame members 16*b* through 16*e* are coupled to the bracket 19. When the frame member 16*e* is moved from adjacent the first side 28 of the hub 12 to adjacent the second side 30 of the hub 12, the bracket 19 pivots about axis A-A (shown in FIG. 10), which moves the frame members 16*b* through 16*d* into their extended positions. To secure the frame member 16*e* in the extended position, a spring pin 21 may be extended through at least vertical plate 15 and frame member 16*e*. The spring pin 21 includes a knob 21*a* adjacent a proximal end thereof and a distal end 11 (also shown in FIG. 10). The distal end 11 is biased toward vertical plate 17 by a spring or other biasing mechanism. The distal end 11 is biased into engagement with an opening 23 defined in vertical plate 15 (shown in FIG. 6) and an opening defined in the frame member 16*e* (not shown) that aligns with opening 23 when the frame member 16*e* is in the extended position. To move the frame members 16*b* through 16*e* from the extended position to the collapsed position, the knob 21*a* is pulled away from the vertical plate 15 to disengage the distal end 11 from opening 23 and the opening in the frame member 16*e* while frame member 16*e* is lifted from the second side 30 of the hub 12 and moved toward the first side 28 of the hub 12. Other implementations may include other suitable fasteners. For example, as discussed below in relation to FIGS. 18A-20F, quick-release pins (e.g., faspins) may be used.

The bracket 19 is shown in FIGS. 6 and 9. The bracket 19 includes an inner bracket plate 19*a* and an outer bracket plate 19*b*. The inner and outer bracket plates 19*a*, 19*b* are spaced apart from each other and lie in generally parallel planes with respect to each other. Bolts 25*c*-25*h* extend through the bracket plates 19*a*, 19*b*. First end portions 22 of the frame members 16*b* through 16*e* are coupled to the bracket 19 by extending bolts 25*c*-25*e* and 25*g* through openings defined in the first end portions 22. The openings defined in the first end portions 22 are disposed between the bracket plates 19*a*, 19*b*, and the bolts 25*c*-25*e* and 25*g* are extended through the openings. In particular, frame member 16*b* is secured to the bracket 19 via bolt 25*c*, frame member 16*c* is secured to the bracket 19 via bolt 25*d*, and frame member 16*d* is secured to the bracket 19 via bolt 25*e*, and frame member 16*e* is secured to the bracket 19 via bolt 25*g*.

The bracket plates 19*a*, 19*b* are substantially V-shaped as viewed from a side of the plates, or in the direction of the axis A-A extending through the plates 19*a*, 19*b*. The openings for bolt 25*f*, through which the axis A-A extends, extend through the V-shaped plates adjacent a first end of the plates 19*a*, 19*b*, and the openings for bolt 25*g* extend through the V-shaped plates adjacent a second, opposite end of the plates 19*a*, 19*b*. The openings for bolt 25*d* extend through an apex of the V-shaped plates. The openings for bolt 25*c* extend through a portion of the V-shaped plates between the first end and the apex, and the openings for bolt 25*f* extend through a portion of the V-shaped plates between the second end and the apex. When in the extended position, the V-shaped plates are pivoted about axis A-A such that the apex is higher than the first and second ends of the plates (e.g., an inverted V). When the frame members are in the collapsed position, the V-shaped plates are pivoted about axis A-A such that the first and second ends of the V-shaped plates are substantially aligned vertically and the apex extends toward the first end 28 of the hub 12. When in this collapsed position, the frame members 16*b* through 16*e* are stacked on top of each other and frame member 16*a*. The bracket plates 19*a*, 19*b* may also define one or more openings 27 spaced between adjacent openings for the bolts 25*c*, 25*d*, 25*e*, 25*g* to reduce the weight of the bracket plates 19*a*, 19*b*.

To prevent the bracket plates 19*a*, 19*b* from moving inwardly toward each other, an axial spacer 47 may be disposed between the bracket plates 19*a*, 19*b* and held in place via bolt 25*h*, which extends through openings defined in the apex of the bracket plates 19*a*, 19*b* vertically below the openings for bolt 25*d* when the frame members 16*b* through 16*e* are in their expanded configuration.

The following listing provides exemplary dimensions of the various features described above. However, these dimensions are exemplary and should not be considered to limit the scope of the invention. Other dimensions may be selected. The height of the vertical plates 15, 17 $H_B$ may be about 6.1 inches and a width $W_B$ of the plates 15, 17 may be about 14.25 inches. The spacing between the plates 15, 17 may be at least about 2 inches. The depth of the base 13 may be about 7 inches. A distance between ends of the V-shaped bracket plates 19*a*, 19*b* may be about 5 inches, and a distance between the apex and the end that defines the opening for receiving bolt 25*g* is about 4.31 inches. The spacing between the plates 19*a*, 19*b* is about 1.34 inches.

The bracket 19 is pivotably coupled to the hub 12 by a bolt 25*f* that extends through openings defined in the vertical plates 15, 17 and the bracket plates 19*a*, 19*b*. The openings are aligned along axis A-A, which is shown in FIG. 10. The bracket 19 is disposed between and spaced apart from the vertical plate 15, 17. For example, one or more axial spacers 41 are disposed around the bolt 25*f* between vertical plates 17 and bracket plate 19*b* and between vertical plate 15 and bracket plate 19*a*.

Frame member 16*a* is stationary relative to the hubs 12, 14. The first end portion 22 of frame member 16*a* is coupled to the hub 12 and the second end portion 24 is coupled to hub 14 such that the frame member 16*a* lies on the ground, extending from the first sides 28 of the hubs 12, 14. For example, the frame member 16*a* may define two or more openings adjacent each of the first end portion 22 and the second end portion 24. The vertical plates 15, 17 of each hub 12, 14 may also define openings for aligning with the openings adjacent the first end portion 22 and the second end portion 24 of the frame member 16*a*. The openings in vertical plates 15, 17 are defined adjacent the first side 28 of the plates 15, 17, and centers of each opening in the vertical plates 15, 17 are horizontally aligned within a plane that is substantially parallel to the base 13. Bolts 25*a* and 25*b* may be engaged through the aligned openings in the vertical plates 15, 17 and the respective end portions 22, 24 of the frame member 16*a* to secure the frame member 16*a* relative to the hubs 12, 14, respectively. Frame member 16*a* may be prevented from moving axially along the bolts 25*a* and 25*b* by disposing axial spacers 41 and spacer plates 43 on the bolts 25*a*, 25*b* on each side of the frame member 16*a*, as shown in FIG. 10. In particular, the axial spacers 41 may be disposed between the vertical plates 15, 17 and the spacer plates 43, and the frame member 16*a* may be disposed between the spacer plates 43.

The pivoting bracket 19 allows all the frame members 16*b* through 16*e* to be mounted in-line with each other while maintaining pivoting around a central point. This facilitates movement between the expanded and collapsed positions and storage of the tent 10 in its collapsed position.

Figure 18A:
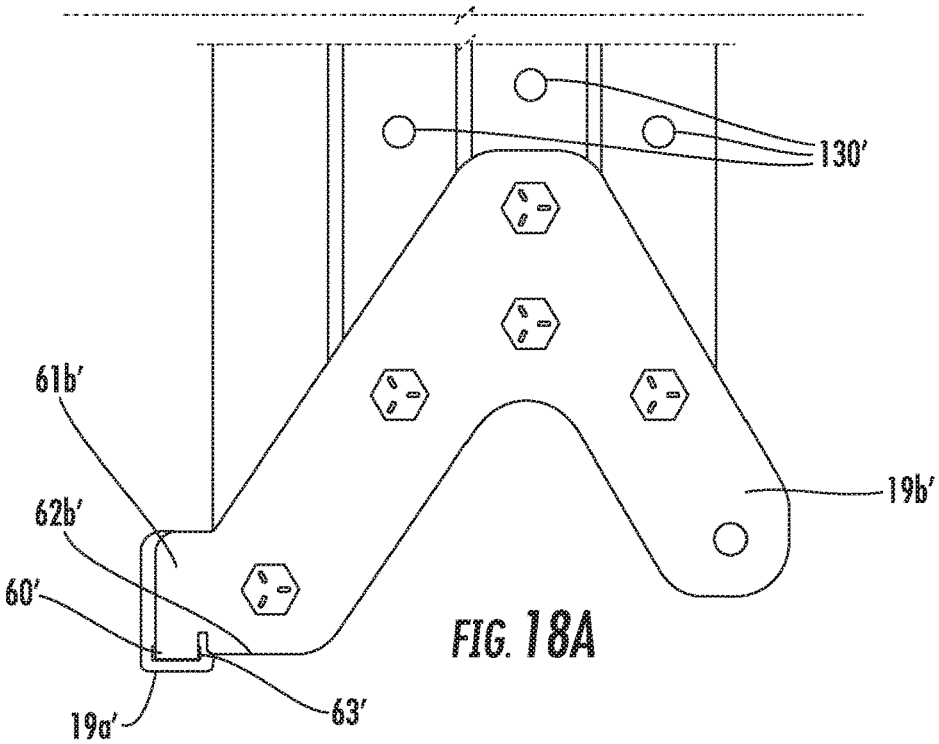
FIGS. 18A-18C illustrate side, top, and perspective views, respectively, of a pivotable bracket according to one implementation.
Figure 18B:
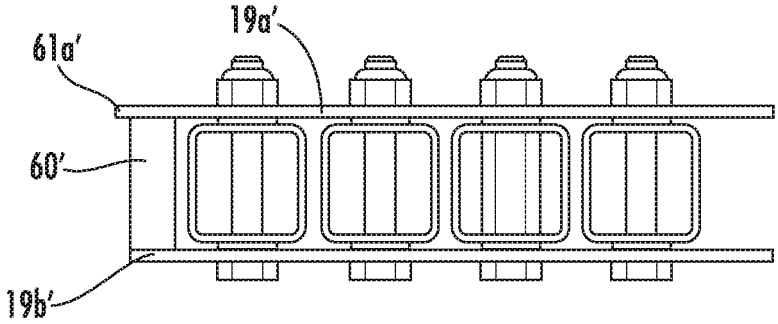
Figure 18C:
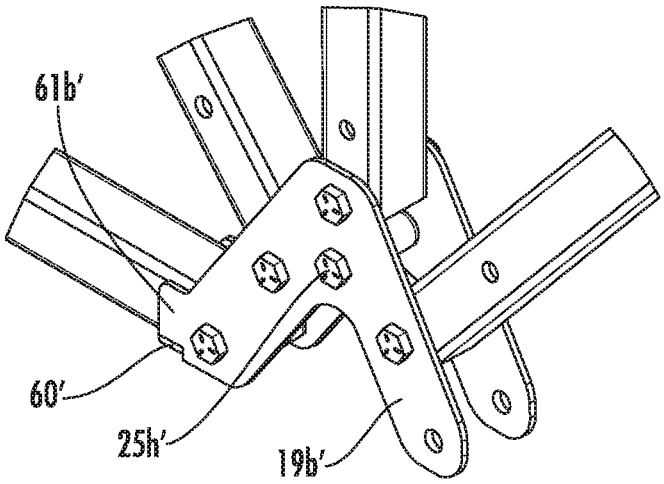

FIGS. 18A-28 illustrate a tent and tent frame assembly according to another implementation that is similar to the tent and tent frame assembly described above in relation to FIGS. 1-12, except for the differences described below. For example, as shown in FIGS. 18A-18C, one of the V-shaped bracket plates 19*a*' includes a tab 60', or stop flange, that extends from a lower surface 62*b*' of the second end 61*b*' of the V-shaped bracket plate 19*b*' toward a lower surface of the second end 61*a*' of the other V-shaped bracket plate 19*a*'. The tab 60' extends from bracket plate 19*b*' and passes through an opening 63' defined in bracket plate 19*a*'. Bolts 25*h*' and 25*f* couple the bracket plates 19*a*', 19*b*' together. This tab 60' limits the rotation of the frame member 16*e*'. In this implementation, the tab 60' is integrally formed with the bracket plate 19*b*' and engaged within the opening 63' of bracket plate 19*a*' during assembly. In other implementations (not shown), the tab 60' may extend from the bracket plate 19*a*' toward bracket plate 19*b*'. And, in some implementations, the tab 60' may be separately formed from the bracket plates 19*a*' and coupled to the ends 61*a*', 61*b*' prior to or after the bracket plates 19*a*', 19*b*' are assembled together.

In addition, the vertical plates 15', 17' of the hubs 12', 13' shown in FIGS. 19A-19F include wear pads 65' coupled to inwardly facing surfaces of the vertical plates 15', 17'. The wear pads 65' have inwardly facing surfaces that abut stationary frame member 16*a*' and abut the pivotable frame members 16*b*'-16*e*' as the pivotable frame members 16*b*'-16*e*' are moved from the collapsed position to the extended position. In some implementations, the wear pads 65' are made from a material that is softer than the frame members 16*a*'-16*e*' (e.g., HDPE) to avoid scratching the frame members 16*a*'-16*e*', yet sufficiently rigid to keep the frame members 16*a*'-16*e*' in line with each other during movement of the frame members 16*b*'-16*e*' relative to the plates 15', 17'. In the implementation shown, each of the wear pads 65' has an outer perimeter 66' that generally follows an outer perimeter 67' of the plates 15', 17' and an inner perimeter 68' that is spaced apart from the outer perimeter 66' and defines a channel 69' below the inner perimeter 68'. End portions of fasteners 25*c*', 25*d*', 25*h*', 25*e*', 25*g*' extending through the bracket plates 19*a*', 19*b*' may extend into the channel 69', which prevents the wear pad 65' from interfering with the movement of the bracket plates 19*a*', 19*b*'. The wear pads 65' prevent wear and tear on the frame members 16*a*'-16*e*' and keep the frame members 16*a*'-16*e*' aligned between the plates 15', 17'. In other implementations, the wear pads may have other shapes that allow them to guide the frame members during movement between the expanded and collapsed positions without interfering with the movement of the fasteners coupling the pivotable frame members to the bracket plates.

In addition, the wear pads 65' may be removed from the vertical plates 15', 17' and replaced if they wear down according to some implementations. For example, the wear pads 65' may be coupled to the vertical plates 15', 17' using screws and nuts or other suitable fastening mechanism that allows for replacement of the wear pads 65'. To prevent the fasteners from scratching the frame members, the wear pads 65' may define depressions adjacent the openings for receiving fasteners to allow a screw head to be disposed in a different plane than the facing surface of the wear pad 65'. In addition, the frame members 16*a*'-16*e*' may have beveled or rounded edges to allow the frame members 16*b*-16*e* to move more easily between the wear pads 65'.

As shown in FIGS. 19A-19F, the tent frame assembly may also include a removable pin 71' tethered to each hub 12', 13' via tether 72'. Opening 23' defined in vertical plate 15' and opening (not shown) defined in frame member 16*e*' align when the frame member 16*e*' is in the extended position, and the pin 71' is slidably engaged through the aligned openings to prevent the frame member 16*e*' from moving relative to the vertical plate 15'.

The pin 71' shown in FIGS. 19A-19F is a quick-release type pin, or faspin. However, in other implementations, other types of fasteners may be used to selectively secure the frame member 16*e*' from movement relative to the vertical plate 15'.

Figure 20A:
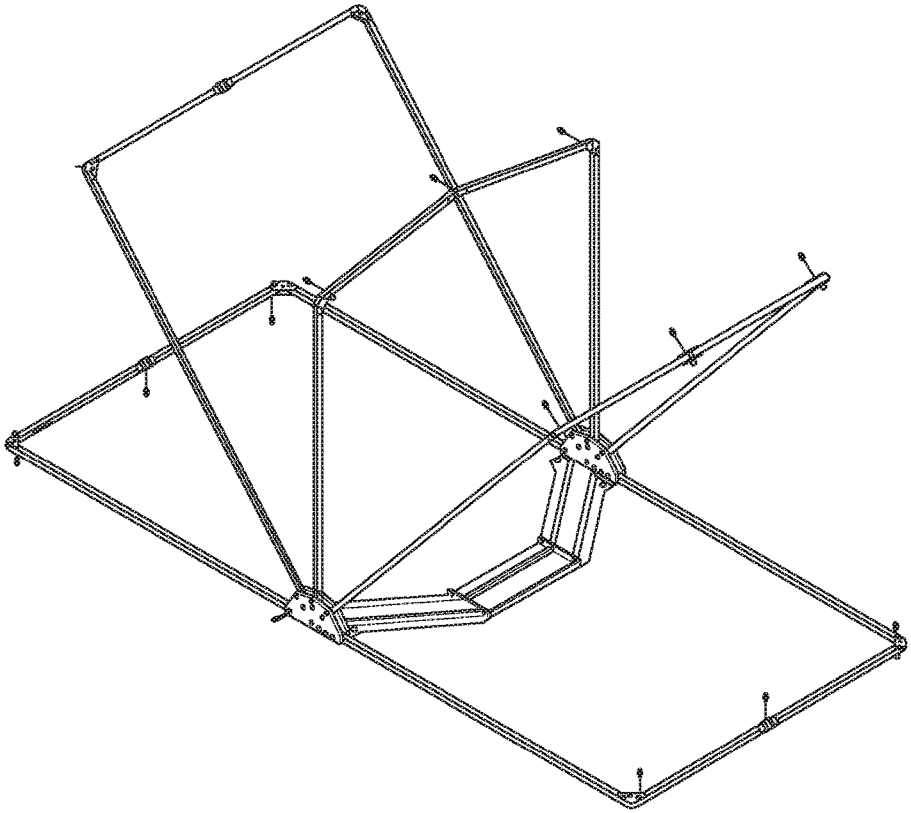
FIGS. 20A-20D illustrate perspective, end, side, and top views of a tent frame assembly in an expanded and unfolded position, according to one implementation.
Figure 20B:
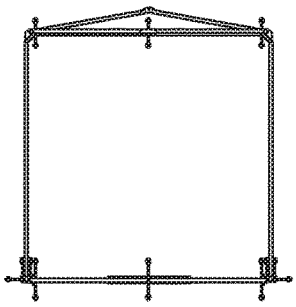
Figure 20C:
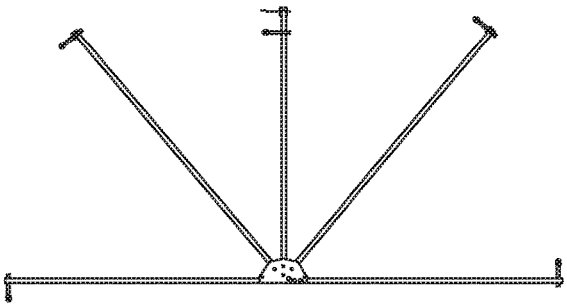
Figure 20D:
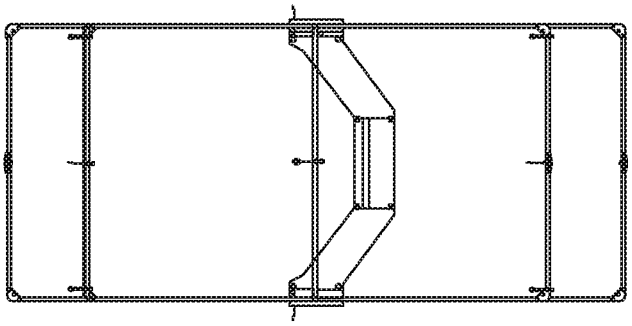
Figure 20E:
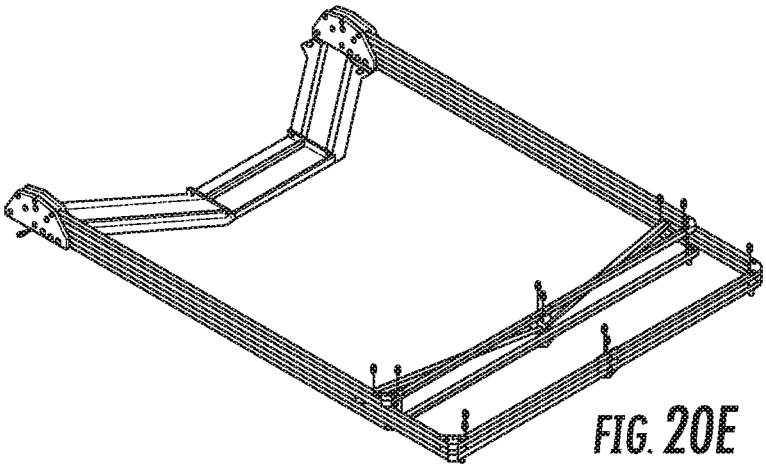
FIG. 20E illustrates a perspective view of the tent frame assembly shown in FIGS. 20A-20D in the unfolded position and collapsed position.
Figure 20F:
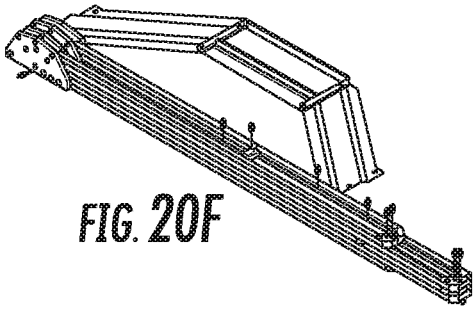
FIG. 20F illustrates a perspective view of the tent frame assembly shown in FIGS. 20A-20D in the folded and collapsed position.

In addition, as shown in FIGS. 20A-20F, each frame member 16*a*'-16*e*' includes four supports that are hingedly coupled together to allow each frame member to move between a folded position and an unfolded position. FIGS. 20A-20D show the frame members 16*a*'-16*e*' in the expanded and unfolded positions. FIG. 20E shows the frame members 16*a*'-16*e*' in a collapsed but unfolded positions, and FIG. 20F shows the frame members 16*a*'-16*e*' in the collapsed and folded positions. By folding the supports of the frame members 16*a*'-16*e* toward each other, the collapsed frame members 16*a*'-16*e*' take up less space when being stored and/or moved.

Figure 21A:
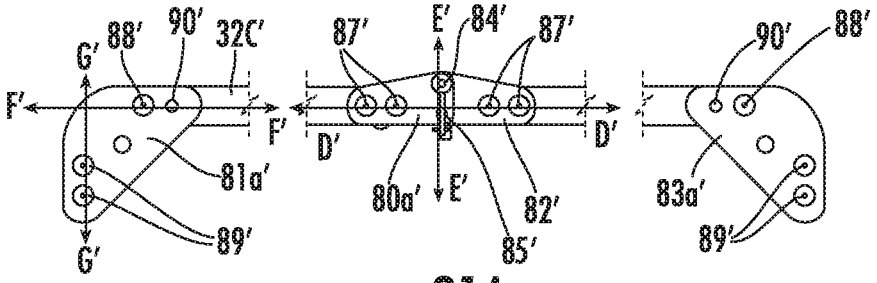
FIGS. 21A-21C illustrate side, top, and bottom views of central plates and end plates coupling end supports and two central supports of a frame member, according to one implementation.
Figure 21B:
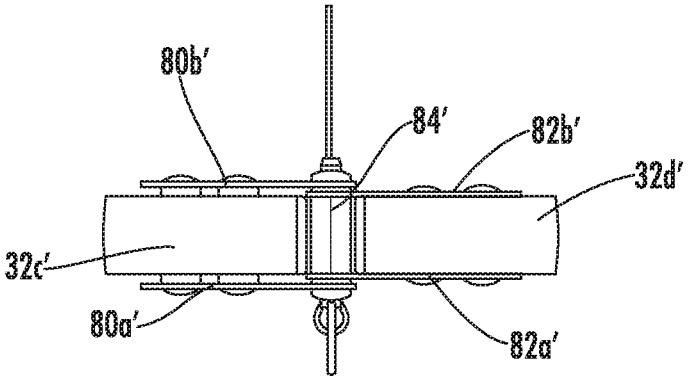
Figure 21C:
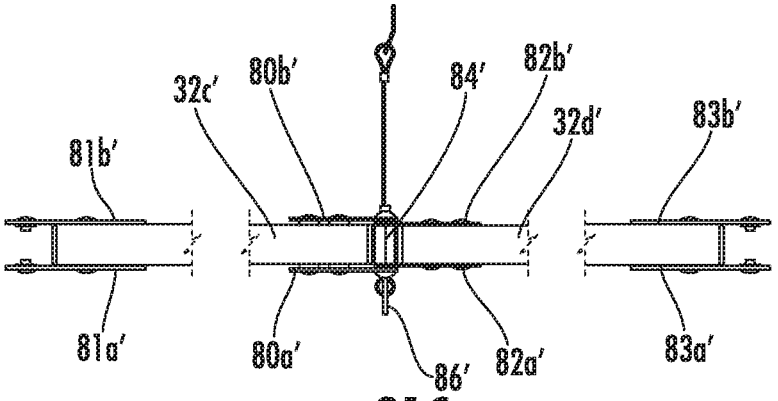
Figure 22A:
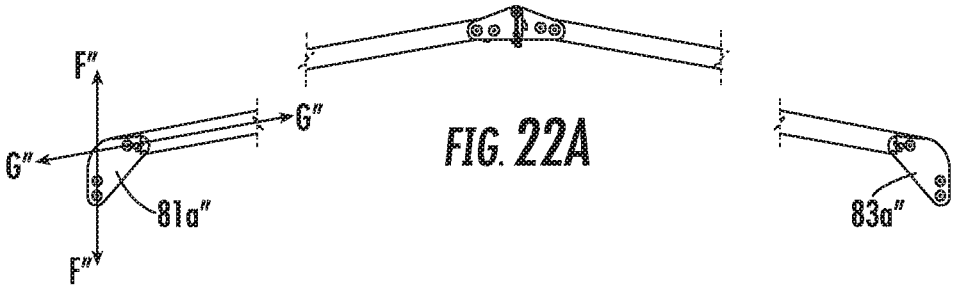
FIGS. 22A-22D illustrate side, top, bottom, and a close up top view of central plates according to another implementation.
Figure 22B:
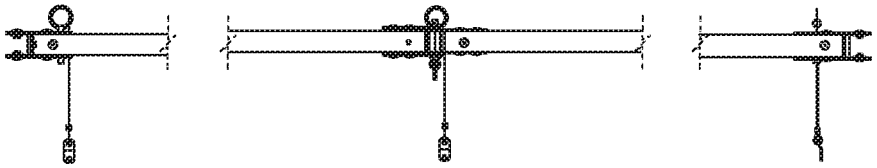
Figure 22C:
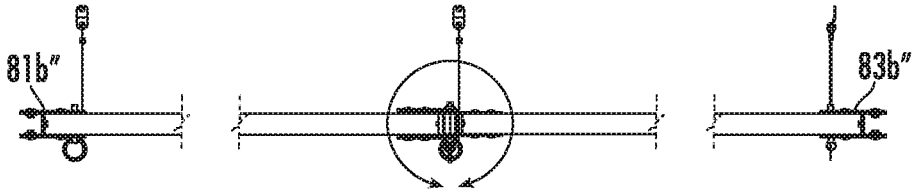
Figure 22D:
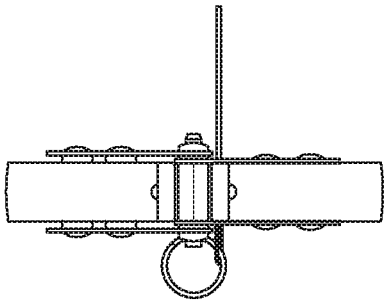
Figure 23A:
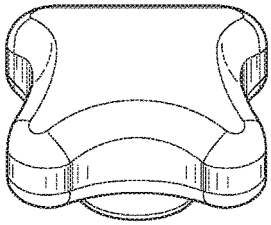
FIGS. 23A-23D illustrate perspective, top, side, and cross sectional views of a four arm knob according to one implementation.
Figure 23B:
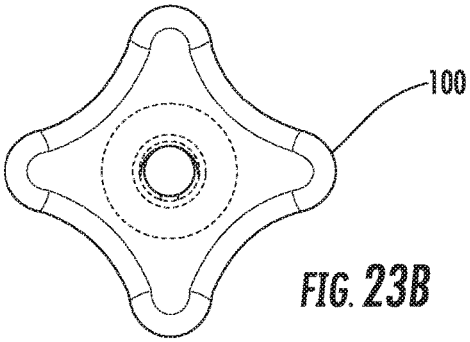
Figure 23C:
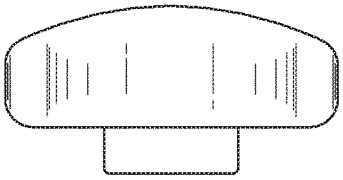
Figure 23D:
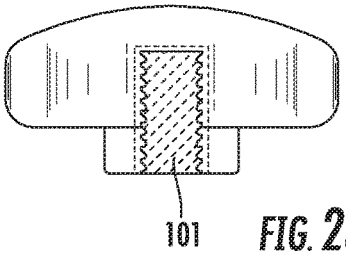

Each frame member 16*a*'-16*e*' includes an end support 32*a*', 32*b*' and two cross supports 32*c*', 32*d*'. FIGS. 21A-21C illustrate plates for hingedly coupling the cross supports 32*c*', 32*d*' to each other and to the end support 32*b*', 32*a* adjacent the respective cross support 32*c*', 32*d*'. As shown, central plates 80*a*', 80*b*' are non-pivotably, or statically, coupled to each side of cross support 32*c*' adjacent one end of the cross support 32*c*', central plates 82*a*', 82*b*' are statically coupled to each side of cross support 32*d*' adjacent one end of the cross support 32*d*', end plates 81*a*', 81*b*' are pivotably coupled to each side of cross support 32*c*' adjacent the other end of cross support 32*c*', and end plates 83*a*', 83*b*' are pivotably coupled to each side of cross support 32*d*' adjacent the other end of cross support 32*d*'. End plates 81*a*', 81*b*' are also statically coupled to each side of end support 32*b*' adjacent a distal end of end support 32*b*'. The end plates 83*a*', 83*b*' are also statically coupled to each side of a distal end of the end support 32*a*'.

Each central plate 80*a*', 80*b*', 82*a*', 82*b*' defines openings for receiving fasteners to secure the plates to the respective support members 32*c*', 32*d*' and each other. In particular, two openings 87' in each plate 80*a*' 80*b*', 82*a*', 82*b*' are defined along a longitudinal axis D'-D' of the respective plate, and two openings 84' and 85' are defined along a transverse axis E'-E'. In the implementation shown, axis D'-D' is orthogonal to the E'-E' axis. However, in other implementations, the relative angle of these axes may be different. When coupled to the cross supports 32*c*', 32*d*', opening 84' is above opening 85' along the E'-E' axis. The openings 87' are aligned with openings (not shown) defined by the cross supports 32*c*', 32*d*', and a fastener is slidably engaged through each set of aligned openings to secure the plates 80*a*', 80*b*', 82*a*', 82*b*' to respective ends of the cross supports 32*c*', 32*d*'. A fastener is also slidably engaged through the aligned openings 84' to hingedly couple the plates 80*a*', 80*b*', 82*a*', 82*b*' together. The plates 80*a*', 80*b*', 82*a*', 82*b*' hinge, or pivot, about the fastener engaged through openings 84'. When the cross supports 32*c*', 32*d*' are in the unfolded position, the openings 85' are aligned, and a pin, such as a quick-release pin or any suitable pin or other type of fastener, is slidably engaged through the openings 85' to prevent the plates 80*a*', 80*b*', 82*a*', 82*b*' from pivoting about the fastener engaged through openings 84'.

Each end plate 81*a*', 81*b*', 83*a*', 83*b*' defines a first opening 88' and a second opening 90' along a first axis F'-F' and two openings 89' along a second axis G'-G'. The first axis F'-F' is disposed at an angle to the second axis G'-G' that is between 90° and 135°. For example, axis F'-F' of end plates 81*a*', 81*b*', 83*a*', 83*b*' is shown at an angle of 90° to axis G'-G'. However, as shown in FIGS. 22A-22D, the axis F"-F" of end plates 81*a*", 81*b*", 83*a*", 83*b*" is disposed at an angle of 100° with the axis G"-G". According to the implementation shown in FIGS. 20A-20F, plates 81*a*', 81*b*', 83*a*', 83*b*', which are shown in FIGS. 21A-21C, are used to couple the end supports 32*a*', 32*b*' and the cross supports 32*c*', 32*d*' for frame members 16*a*', 16*b*', 16*d*', and 16*e*'. And, plates 81*a*", 81*b*", 83*a*", 83*b*" shown in FIGS. 22A-22D are used to couple the end supports 32*a*', 32*b*' and the cross supports 32*c*', 32*d*' for central frame member 16*c*'.

Each cross support 32*c*', 32*d*' defines two openings (not shown) adjacent the end that couples to the end plate 81*a*', 81*b*', 83*a*', 83*b*'. The opening nearest the end of the respective cross support 32*c*', 32*d*' is aligned with openings 88' of the respective end plate 81*a*', 81*b*', 83*a*', 83*b*', and a fastener is slidably engaged through the aligned end openings to pivotably couple the plates 81*a*', 81*b*', 83*a*', 83*b*' with the cross supports 32*c*', 32*d*', respectively. The opening disposed inwardly (toward the central plates) of the fastener opening on the cross supports 32*c*', 32*d*' is aligned with the opening 90' in the respective end plates 81*a*', 81*b*', 83*a*', 83*b*' when the cross supports 32*c*', 32*d*', respectively, are unfolded, and a pin is engaged through the openings 90' to prevent the cross supports 32*c*', 32*d*' from pivoting about the fastener engaged through openings 88'. The pin is removed to allow the cross supports 32*c*', 32*d*' to fold toward each other.

To fold the cross supports 32*c*', 32*d*' together, the pins are removed from the openings 85', 90' and the cross supports 32*c*', 32*d*' pivot toward each other about the fasteners extending through openings 84', 88'. As viewed from the extended and unfolded position, the cross supports 32*c*', 32*d*' pivot upwardly about the fastener engaged through openings 84', and the cross supports 32*c*', 32*d*' pivot downwardly about the fasteners engaged through openings 88'.

The end supports 32*a*', 32*b*' define two openings adjacent the distal ends of the end supports 32*a*', 32*b*' that are aligned with openings 89' of the respective end plates 83*a*', 83*b*', 81*a*', 81*b*', and a fastener is slidably engaged through each set of aligned openings to statically couple the end supports 32*a*', 32*b*' and the end plates 83*a*', 83*b*', 81*a*', 81*b*', respectively.

Figure 19A:
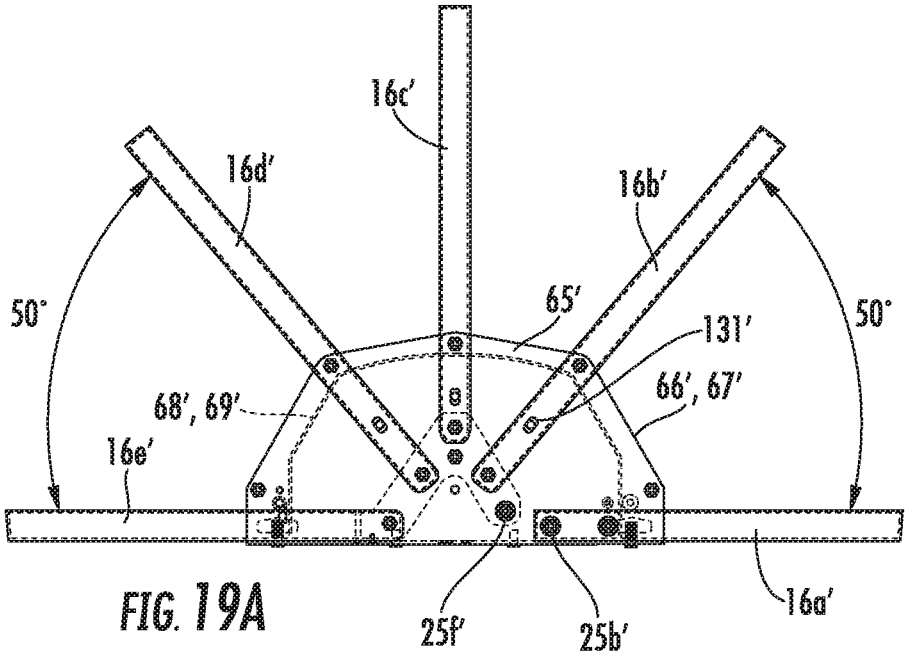
FIGS. 19A-19C illustrate side, top, and end views of a right side hub assembly.
Figure 19B:
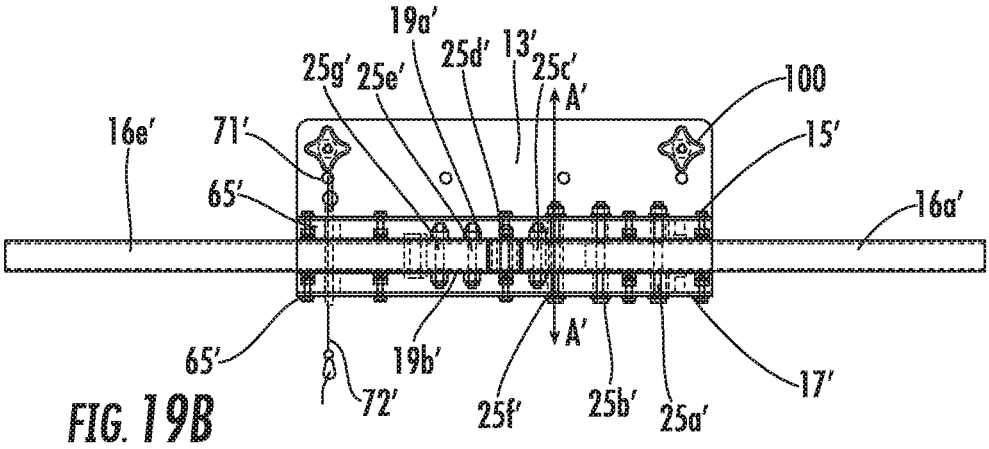

As shown in FIGS. 18A and 19A, at least one pivoting frame member 16*b*'-16*e*' defines an opening 130' that aligns with an opening 131' defined in at least one vertical plate 15', 17' of the respective hub 12', 13'. The opening 131' in the vertical plate 15', 17' corresponds to where the pivoting frame members 16*b*'-16*e*' are expected to be in the expanded position. A pin, such as those discussed above, may be engaged into the aligned openings 131', 130' of the plate 15', 17' and the frame member 16*b*'-16*e*', respectively, to prevent the frame members 16*b*'-16*e*' from moving into the collapsed position. In some implementations, the pins are used prior to the cover being coupled to the frame members, but in other implementations, the pins may also be used after the cover is coupled to the frame members. In addition, in some implementations, the frame member 16*e*' that rests adjacent the ground in the expanded configuration may not include the openings 130' if the weight of the frame member 16*e*' is sufficient to hold the frame member 16*e*' in its expanded position.

Figure 19C:
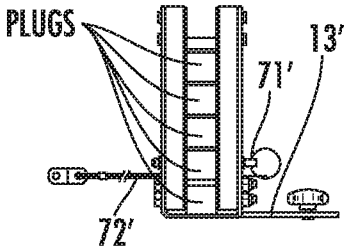
Figure 19D:
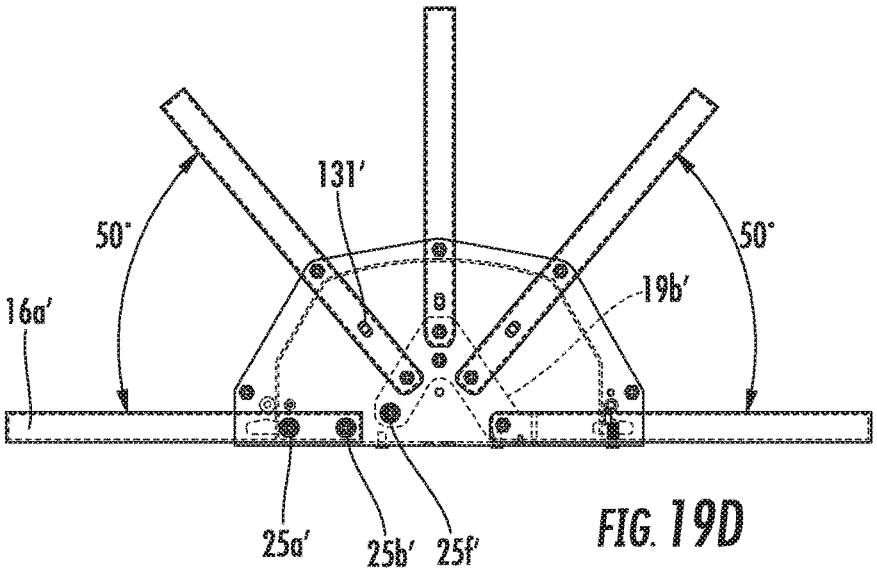
FIGS. 19D-19F illustrate side, top, and end views of a left side hub assembly, according to one implementation.
Figure 19E:
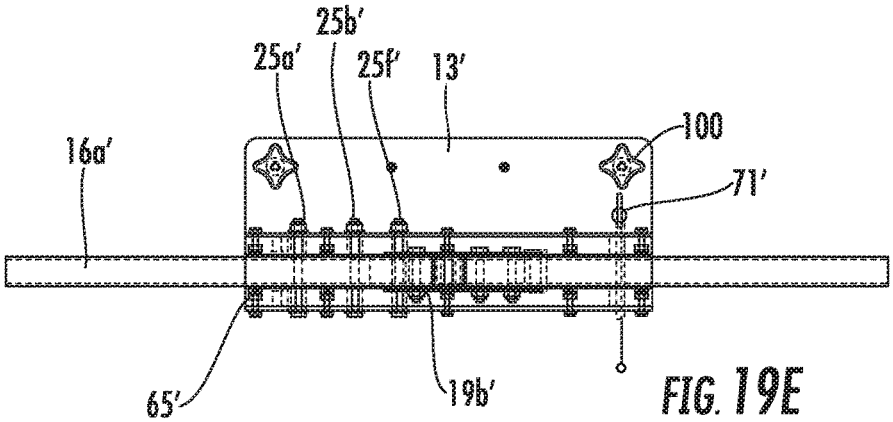
Figure 19F:
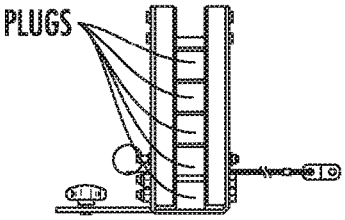

Furthermore, as shown in FIGS. 19C and 19F, plugs may be coupled to the ends of the end supports 32*a*', 32*b*' of the frame members 16*a*'-16*e*' to prevent water, dirt, and/or debris from entering an interior of the frame members 16*a*'-16*e*'. In one implementations, the plugs are made of polyethylene or other suitable polymer or material.

In other implementations (not shown), two or more adjacent frame members may be tied together such that the adjacent frame members cannot pivot past a predetermined angle from each other. The predetermined angle may be between 30° and 60° from each other, and the angle may be controlled by the length of the tie extending between adjacent frame members. In alternative implementations, the frame members 16*a*-16*e* may be secured in the expanded position relative to the hubs 12, 14 using other suitable mechanisms, such as, for example, biased pins and corresponding apertures.

Figure 13:
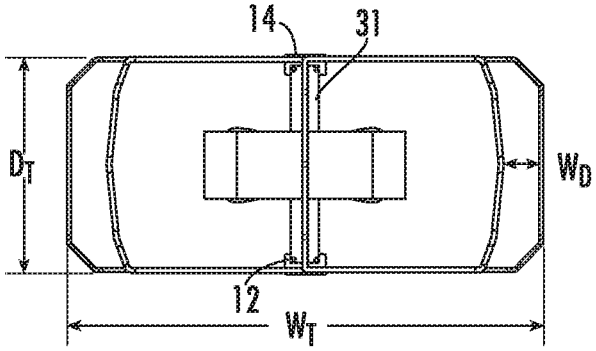
FIG. 13 is a top view of the tent assembly shown in FIG. 1 without the cover in the expanded position.
Figure 14A:
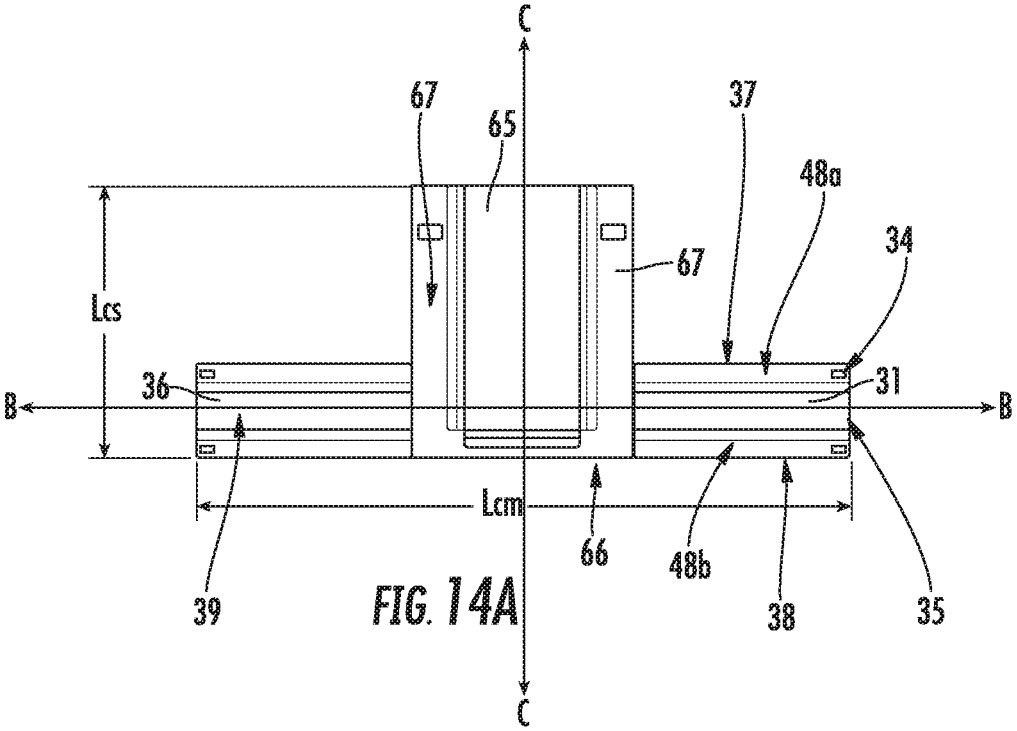
FIG. 14A is a partial top view of a cross support member with a cart plate coupled thereto, as shown in FIG. 4, according to one implementation.
Figure 14B:
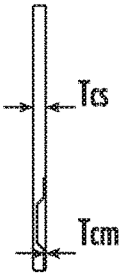
FIG. 14B is a side view of the cross support member and cart plate shown in FIG. 14A.
Figure 14C:
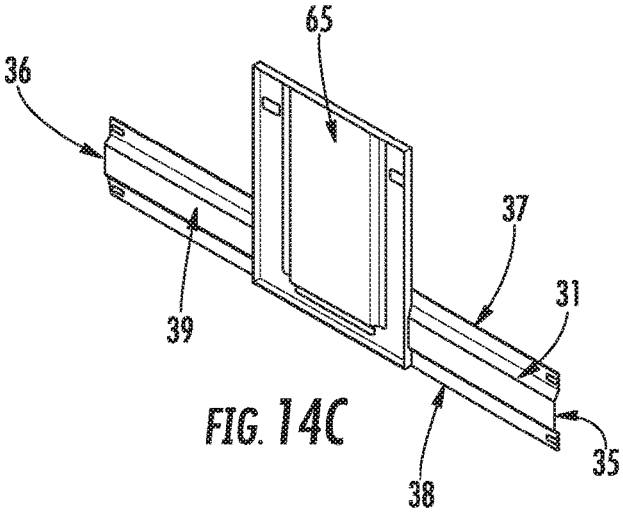
FIG. 14C is a perspective view of the cross support member and cart plate shown in FIG. 14A.
Figure 15:
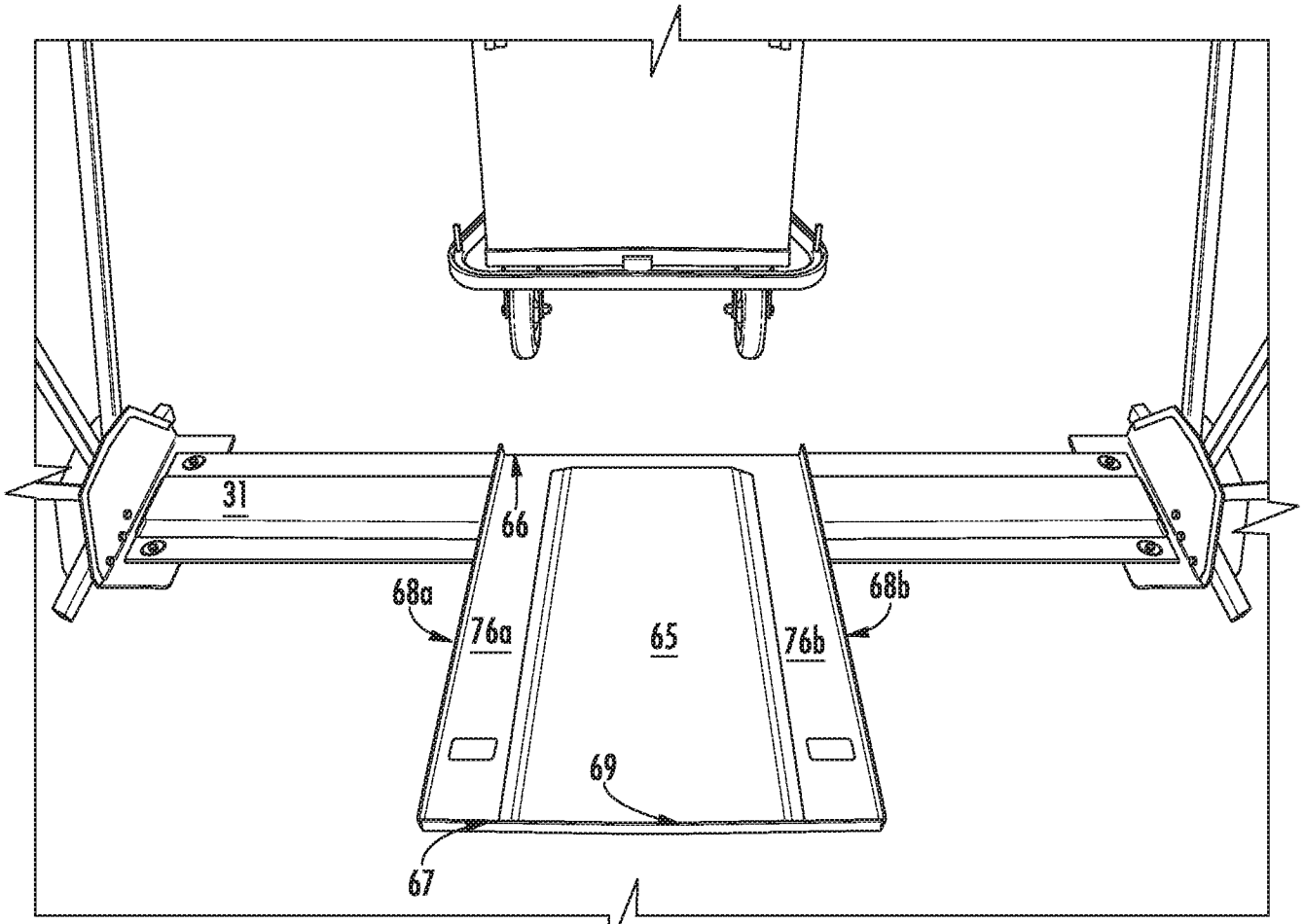
FIG. 15 is a perspective view of the cross support member and cart plate coupled to the hubs of the tent shown in FIG. 1.

In some implementations, the tent assembly may also include a stabilization mechanism to prevent the tent from blowing away or collapsing during windy conditions. As shown in FIGS. 14A through 15, for example, the stabilization mechanism may include a cross support member 31 extending between the hubs 12, 14. The cross-support member 31 stabilizes the tent without the use of additional hardware. The cross-support member 31 is a relatively thin, generally planar, rectangular shaped structure. A longitudinal axis B-B extends along a length of the cross-support member 31 between a first end 35 and a second end 36 thereof. Long edges 37 and 38, which are spaced apart and opposite each other, run generally parallel to the axis B-B and between ends 35, 36. Edge portions 48*a*, 48*b* are adjacent respective long edges 37, 38. A central portion 39 of the member 31 extends between the edge portions 48*a*, 48*b* and is disposed higher above the ground relative to edge portions 48*a*, 48*b*, forming a hat-shaped cross-section. Having the central portion 39 disposed in a different plane than the edge portions 48*a*, 48*b* provides strength to the cross support member 31. As shown in FIGS. 9 and 13-15, the cross support member 31 is coupled to the base 13 of the hubs 12, 14 using one or more bolts 33. The cross support member 31 defines holes 34 at each end 35, 36 thereof, and the base 13 of each hub 12, 14 defines holes for aligning with holes 34 and receiving the bolt 33.

The cross support member 31 may be formed of any suitable material, including, for example, aluminum, steel, plastic, or wood. In addition, a thickness $T_{CM}$ of the cross support member 31 may be 0.1 inches, according to one implementation. In addition, the length $L_{CM}$ of the cross support member 31 is 69.5 inches. However, the length $L_{CM}$ of the cross support member 31 may vary depending on the width of the interior of the tent 10, and the thickness $T_{CM}$ of the cross support member 31 may vary depending on the strength needed for the cross support member 31.

Furthermore, the cross support member 31 may be coupled to the base 13 of the hubs 12, 14 using other suitable fastening mechanisms, such as, for example, screws, rivets, adhesive, etc., or the cross support member 31 may be integrally formed with the hubs 12, 14, in whole or in part. For example, as shown in FIGS. 23A-23D, a four-arm knob 100 may be used with a press in stud (or bolt/screw) to secure the cross support member 31 to the base 13 of hubs 12, 14. In particular, a keyed head of a press in stud may be press fit into a keyed opening defined by a lower surface of the base 13 such that threads of the stud extend upwardly from an upper surface of the base 13, and the head of the stud is prevented from rotation by engaging the keyed head into the keyed opening. The cross support member 31 defines an opening that is disposed around the threaded portion of the stud. A threaded cavity 101 of the four arm knob 100 is threadingly engaged with the threaded portion of the stud to couple the cross support member 31 to the base 13. Because the keyed head of the stud is pressed into the keyed opening of the base 13, the stud is prevented from rotating while the four-arm knob 100 is being coupled to the stud. This allows for one handed assembly without a separate tool, such as a wrench. Also, the four-arm knobs 100, in some implementations, are significantly larger than standard nuts that may be used with standard screws/bolts, which prevents the knobs 100 from being dropped and lost on the athletic field.

One or more cart plates 65 may be coupled to the cross support bar 31 for receiving wheels of a medical cart thereon, further adding to the stability of the tent assembly. The cart plates 65 may be integrally formed with the cross support bar 31 or separately formed and attached thereto using any suitable fastening mechanism. The cart plate 65 may be formed of the same or different material as the cross support member 31. Each cart plate 65 is generally planar and includes a proximal end 66 coupled to the cross support bar 31 and a distal end 67 extending away from the cross-support member 31. For example, an axis C-C extending through the proximal end 66 and the distal end 67 may be perpendicular to the axis B-B of the cross support member 31. The cart plate 65 may also include edges 68*a*, 68*b* extending between the proximal end 66 and the distal end 67. A wall 69 may extend around at least a portion of the perimeter of edges 68*a*, 68*b* and distal end 67. In some implementations, the height of the wall $T_{CS}$ of the cart plate 65 is about 1 to about 1.5 inches (e.g., about 1.25 inches). And, the length $L_{CS}$ of the cart plate 65 is about 29 inches. The wall 69 prevents the wheels of the cart parked on the cart plate 65 from rolling off of the cart plate 65. In addition, the cart plate 65 may define recessed portions 76*a*, 76*b* adjacent the edges 68*a*, 68*b*, respectively, that extend between the proximal end 66 and the distal end 67. The recessed portions 76*a*, 76*b* may be spaced apart such that the wheels of the cart may be received within the recessed portions 76*a*, 76*b*, serving as a guide for the placement of the cart within the tent 10.

The cross support member 31" shown in FIGS. 25A-25D is similar to the cross support member 31 described above in relation to FIGS. 14A-15. However, in FIGS. 25A-25D, there is no cart plate 65 separately attached to the cross support member 31". Instead, the cross support member 31" has two peripheral cross support portions 31*a*", 31*b*" that have the same shape as cross support member 31 and a central pan 90" disposed between the peripheral cross support portions 31*a*", 31*b*". The cross support portions 31*a*", 31*b*" and the central pan 90" may be separately or integrally formed. The central pan 90" has a lower surface 94" and walls 95" that extend upwardly from the lower surface 94" at the perimeter of the pan 90". The central pan 90" may receive a central post(s) that extends downwardly from the cart to prevent the cart from moving unintentionally.

Figure 24A:
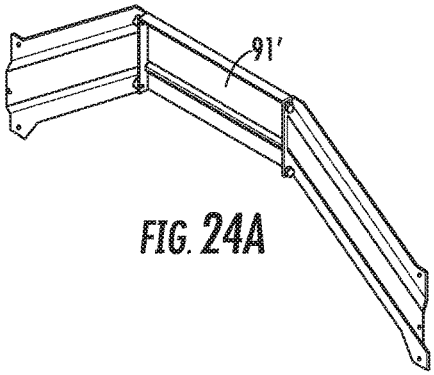
FIGS. 24A-24D illustrate perspective, side, top, and end views of a cross support member according to one implementation.
Figure 24B:
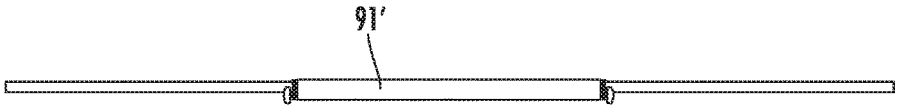
Figure 24C:
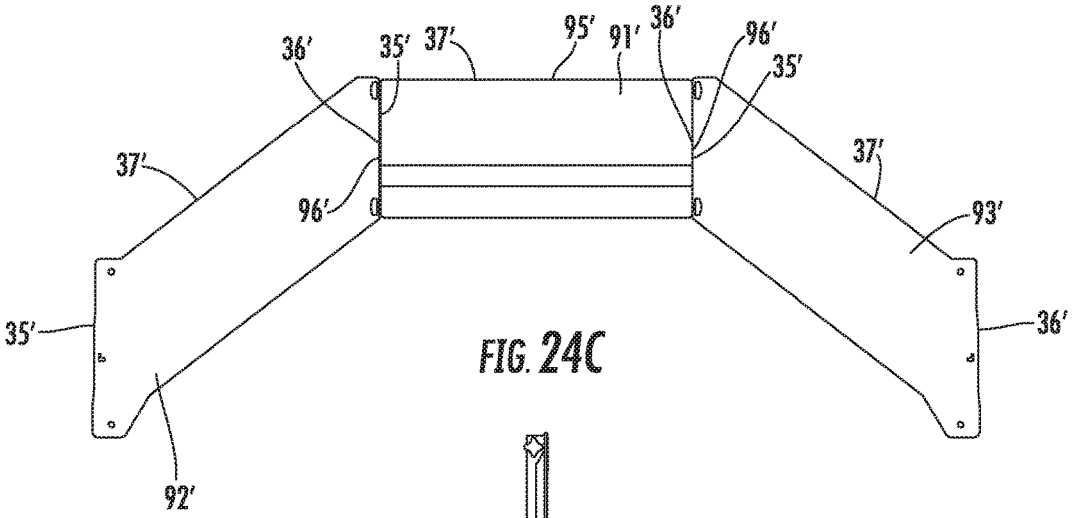
Figure 24D:
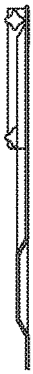
Figure 25A:
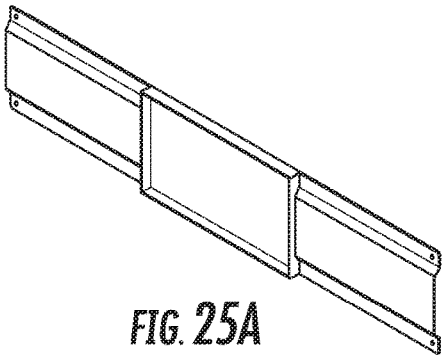
FIGS. 25A-25D illustrate perspective, side, top, and end views of a cross support member according to one implementation.
Figure 25B:
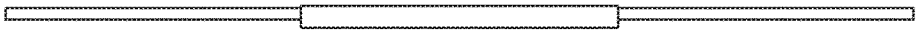
Figure 25C:
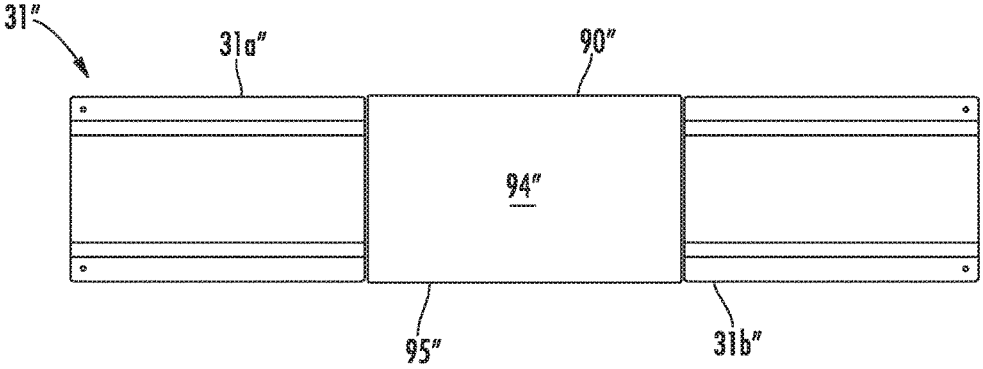
Figure 25D:
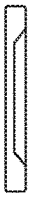
Figure 26:
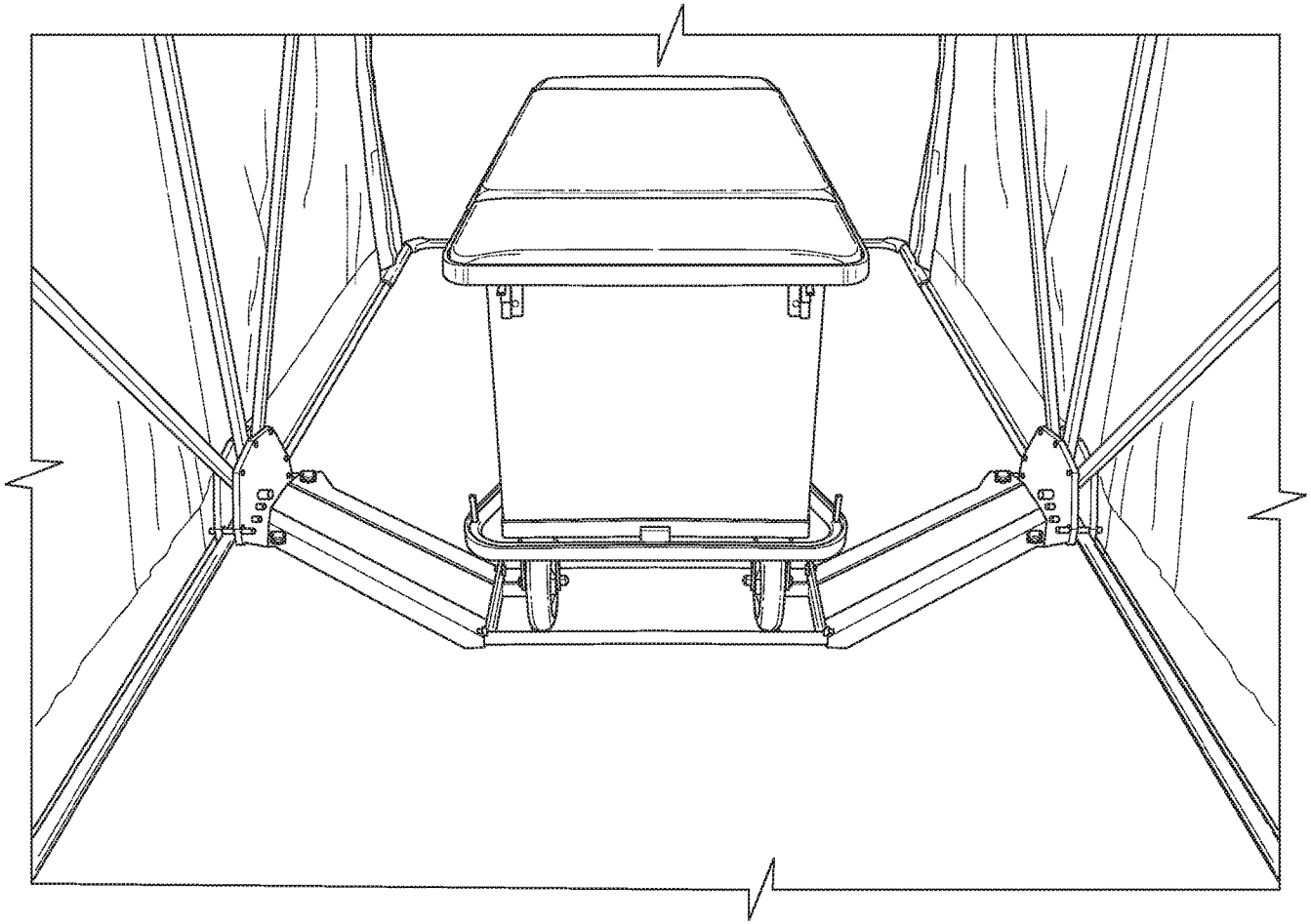
FIG. 26 illustrates a perspective view inside of a tent according to one implementation.
Figure 27:
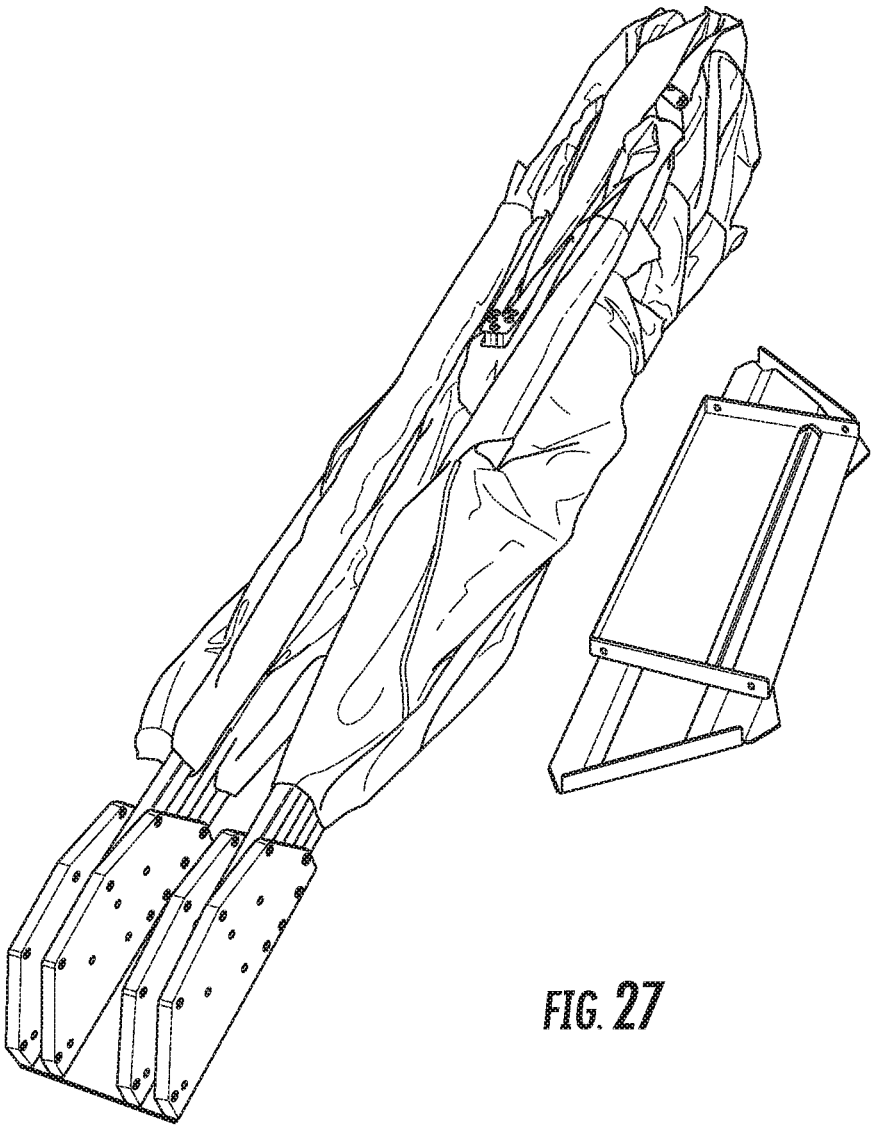
FIG. 27 illustrates a perspective view of a tent in a folded and collapsed position according to one implementation.

FIGS. 24A-24C illustrate a cross support member 31' according to another implementation. Cross support member 31' is similar to cross support members 31, 31" described above in relation to FIGS. 14A-15 and FIGS. 25A-25D in that cross support member 31' has peripheral portions that have a hat-shaped cross section. However, cross support member 31' includes a center pan 91', a left hand portion 92', and a right hand portion 93' that are formed separately and are coupled together using fasteners, such as, for example, the press-in studs and four arm knobs 100 described above in relation to FIGS. 23A-23D. In the implementation shown, each peripheral portion 92', 93' is generally parallelogram shaped, and the central pan 91' is generally rectangular shaped. In particular, each portion 92', 93' and the central pan 91' has long edges 37' and end edges 35', 36'.

The central pan 91' has walls 95' that extend upwardly from a lower surface 94' along one of the long edges 37' and along the end edges 35', 36'. The wall 95' along the long edge 37' prevents the wheels of the cart parked on the lower surface 94' of the central pan 91' from rolling unintentionally past the wall 95'. Press-in studs are disposed through the walls 95' extending from the end edges 35', 36' of the central pan 91' such that the threaded portions of the studs extend horizontally away from the lower surface 94'. Walls 96' extend upwardly from end edges 35', 36' of the peripheral portions 92', 93'. Openings defined in the walls 96' are engaged around the studs extending from walls 95' of the central pan 91', and four arm knobs such as the four arm knobs 100 shown in FIGS. 23A-23D are threadingly engaged onto the studs to couple the peripheral portions 92', 93' to the central pan 91'. In other implementations, the central pan 91' may instead define openings in the walls 95' extending from the end edges 35', 36', and another type of fastener may be engaged through the aligned openings to couple the central pan 91' to the peripheral portions 92', 93'. This cross support member 31' may be disassemble and stacked together for easier transport. In some implementations, one or more press-in studs may be provided in at least one of the peripheral portions 92', 93' or central pan 91' and openings defined in the other portions 92', 93, 91' to couple the stacked portions 92', 93' and/or the central pan 91' together for transport.

Different cross support member configurations may be used for carts have different wheel sizes and/or wheel base sizes and/or different sized tents.

In other implementations (not shown), the stabilization mechanism may include a rod coupled to the medical cart that can be removably coupled to frame members 16*a*, 16*e* to prevent them from pivoting toward each other. The rod, for example, may be a telescoping rod that is coupled to a lower surface of the cart. In addition, the rod may include two or more separate rods that telescope from each end of the cart toward the respective frame members 16*a*, 16*e*. Other stabilization mechanisms may include a weight coupled to the frame members 16*a*, 16*e*, a ground stake extending over the frame members 16*a*, 16*e*, or other suitable stabilization mechanism.

In the above description, five frame members 16*a*-16*e* are described. However, in other implementations, the tent may include any suitable number of frame members.

Figure 11:
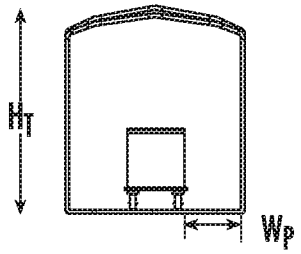
FIG. 11 is an end view of the tent assembly shown in FIG. 1 in the expanded position without the cover coupled to the frame members.
Figure 12:
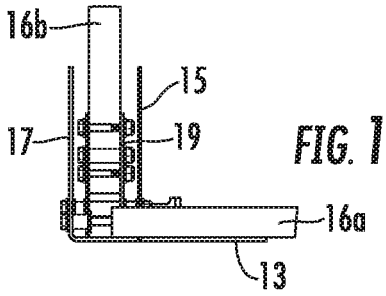
FIG. 12 is a partial end view of the hub 12 and the frame members 16*a*, 16*b* coupled to the hub as indicated by circle A in FIG. 11.

The interior volume defined by the ground and tent cover in the expanded position is a function of the area defined between the frame members 16*a*, 16*e* and the maximum height of the cross portion of frame member 16*c* from the ground in the expanded position. For example, the area defined between the frame members 16*a*, 16*e* and the maximum height of the cross portion of the frame member 16*c* may be selected such that medical staff may move around the injured player and a medical cart within the interior of the tent to perform the medical evaluation. For example, as shown in FIG. 13, the medical tent 10 may have a width WT between cross supports 32*c* of frame members 16*a* and 16*e* in the expanded position of between 150 and 180 inches (e.g., 169 inches), a distance DT between hubs 12, 14 of between 70 and 90 inches (e.g., 77 inches), a height HT of the tent 10 in the expanded position, as measured by a height of the cross support 32*a* of frame member 16*c* from the ground of between 78 inches and 96 inches (e.g., 84 inches). In some implementations, as shown in FIG. 11, the distance DT between the hubs 12, 14 may be selected to allow at least 24 inches of clearance between edges of the medical cart and the hubs 12, 14 for people to move around the medical cart. In other implementations, the minimum distance between hubs 12, 14, between cross supports 32*c* of frame members 16*a* and 16*e*, and between the ground and cross support 32*a* of frame member 16*c* is 60 inches.

The cover 18 may include any suitable collapsible material for providing privacy to the people within the tent 10. In addition, the material may be light weight, anti-microbial, water resistant, water proof, wind proof, and/or breathable. The material may include a fabric material or a netting material. Furthermore, the cover 18 may include one or more layers of material. For example, the cover 18 may include a breathable inner layer and a water and/or wind proof outer layer than can be selectively disposed on top of the breathable inner layer depending on the weather. In addition, the cover 18 may be customized to include a team logo on an outer surface thereof.

In addition, the cover 18 may comprise at least one door on a surface thereof for allowing occupants within the tent 10 to move in and out of the tent while in the extended position. For example, in the implementation shown in FIG. 1, the door comprises two panels 75*a*, 75*b* that hang vertically adjacent each other. The panels 75*a*, 75*b* include inner edges 77*a*, 77*b* and outer edges 78*a*, 78*b*. The outer edges 78*a*, 78*b* are coupled to adjacent walls of the cover 18 via zippers. Each of the inner edges 77*a*, 77*b* defines at least one pocket in which one or more magnets are secured. The magnets are attracted to each other, keeping the inner edges 77*a*, 77*b* of the panels 75*a*, 75*b* together and providing privacy to occupants within the tent 10. However, the attractive force of the magnets may be overcome and the panels 75*a*, 75*b* may be easily separated by a person passing through the panels 75*a*, 75*b* to enter or leave the tent assembly 10. Once the person passes through the door, the magnets pull the edges 77*a*, 77*b* of the panels 75*a*, 75*b* back together to provide privacy for occupants of the tent assembly 10. In addition, when the outer edges 78*a*, 78*b* are not coupled to the adjacent walls, the panels 75*a*, 75*b* may be rolled upwardly and held adjacent the frame member closest to the upper edge of the panels 75*a*, 75*b* (e.g., frame member 16*b* in FIG. 1) using ties or other suitable fastening mechanisms (e.g., hook and loop, snaps, clips, etc.). In other implementations, other suitable fastening mechanisms may be used to secure the panels 75*a*, 75*b* to the walls and to each other, such as, for example, hook and loop, one or more clips, snaps, zippers, and/or ties. In other implementations, the door may include one or more panels.

The cover 18 may include pockets sewn or otherwise fastened to an inner or outer surface of the cover 18, and the pockets are configured for receiving one or more of the frame members 16*a*-16*e*. Alternatively, the cover 18 may be coupled to the frame members 16*a*-16*e* via straps, ties, snaps, zippered pockets, or other suitable fastening mechanisms.

In some implementations, one or more of the frame members 16*b*-16*d* may include one or more hooks, such as hooks that are configured to hold medical supplies. And, in some implementations, at least one light source may be coupled to one or more of the frame members 16*b*-16*d* and/or the inner surface of the cover 18 that faces the interior of the tent 10 in the expanded position. For example, the light source may include an LED rope.

In some implementations, at least one frame member 16*a*-16*e* comprises a handle that may be used to maneuver the tent assembly 10 around the field while in the collapsed position.

In an alternative implementation (not shown), one or more wheels may be coupled to each hub 12, 14. Each wheel may be supported by an axle extending through the hub 12, 14. For example, the axle may be disposed substantially below the center of mass of the tent when in the expanded position to facilitate movement of the tent around the field while in the expanded position. However, in other implementations, the axle may be adjacent to and offset from the point below the center of mass.

Figure 16:
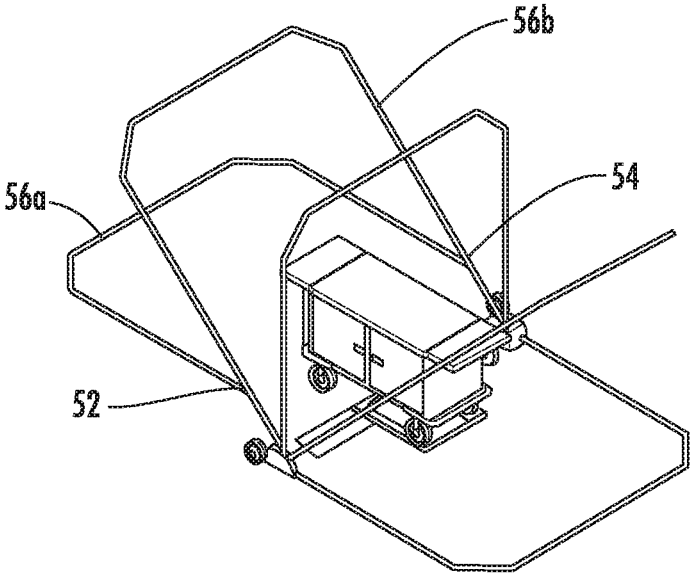
FIG. 16 is a perspective view of a tent assembly according to another implementation without a cover in its expanded position.
Figure 17:
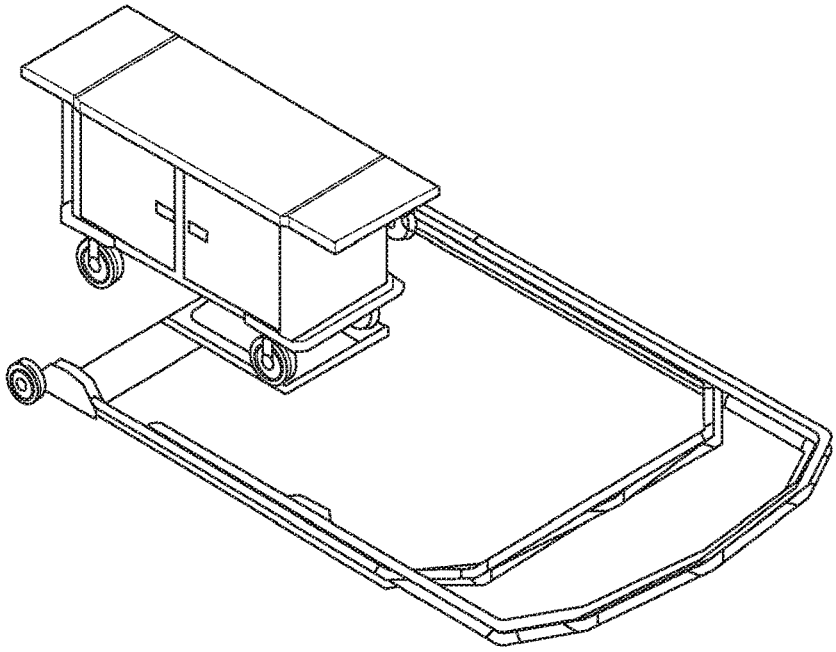
FIG. 17 is a perspective view of the tent assembly of FIG. 16 in a collapsed position without a cover.

In alternative implementations, one or more of the frame members may be pivotably coupled adjacent the hubs 12, 14, and one or more of the frame members may be hingedly coupled to an adjacent frame member. For example, as shown in FIGS. 16 and 17, the ends 52, 54 of one of the frame members 56*a* are hingedly coupled to adjacent frame member 56*b* near the first end 52 and second end 54 of the frame member 56*b*.

Figure 28:
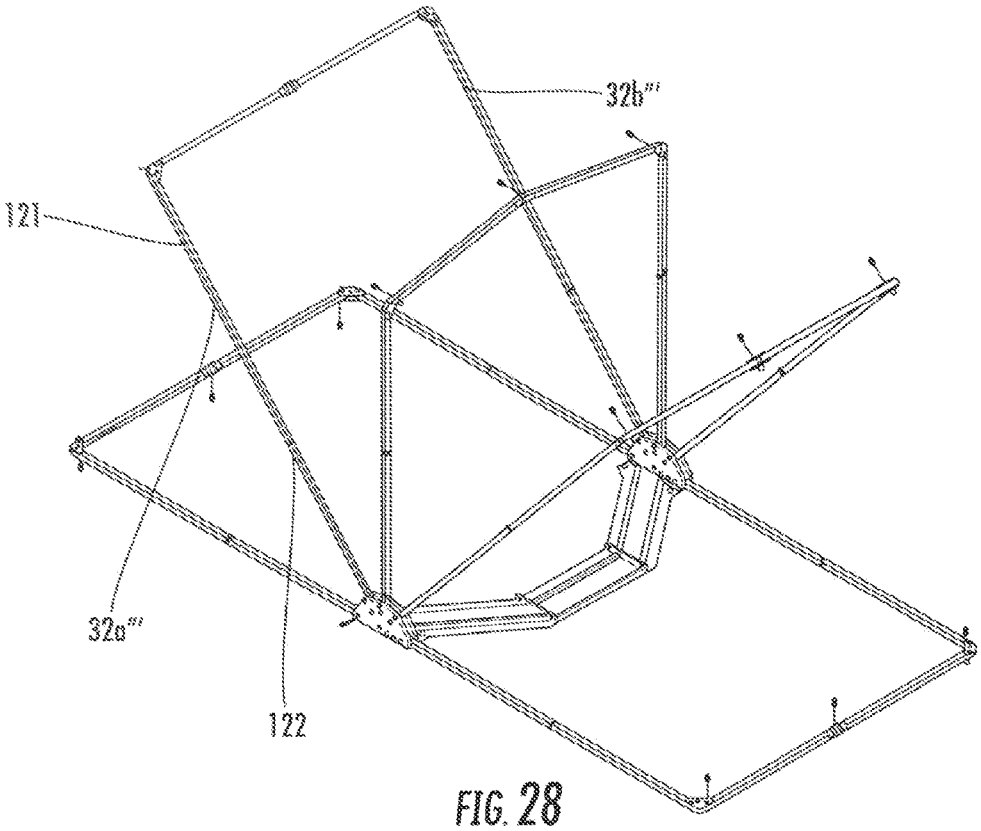
FIG. 28 illustrates a perspective view of a tent having frame members with telescoping supports according to one implementation.

In addition, in another implementation, such as is shown in FIG. 28, the first end support 32*a*''' and the second end support 32*b*''' may include two or more segments 121, 122 that are telescopically slidable relative to each other between a shortened position and an elongated position. For example, segment 121 slides within segment 122 between the shortened and elongated positions. The cross support may also include telescoping segments.

Various modifications of the devices and methods in addition to those shown and described herein are intended to fall within the scope of the appended claims. Further, while only certain representative devices and method steps disclosed herein are specifically described, other combinations of the devices and method steps are intended to fall within the scope of the appended claims, even if not specifically recited. Thus, a combination of steps, elements, components, or constituents may be explicitly mentioned herein; however, other combinations of steps, elements, components, and constituents are included, even though not explicitly stated. The term "comprising" and variations thereof as used herein is used synonymously with the term "including" and variations thereof and are open, non-limiting terms. Those skilled in the art who review this disclosure will readily appreciate that many modifications are possible (e.g., variations in sizes, dimensions, structures, shapes and proportions of the various elements, values of parameters, mounting or layering arrangements, use of materials, colors, orientations, etc.) without materially departing from the novel teachings and advantages of the subject matter described herein. For example, elements shown as integrally formed may be constructed of multiple parts or elements, the position of elements may be reversed or otherwise varied, and the nature or number of discrete elements or positions may be altered or varied. Other substitutions, modifications, changes and omissions may also be made in the design, operating conditions and arrangement of the various exemplary embodiments without departing from the scope of the present embodiments.

Although the subject matter has been described in language specific to structural features and/or methodological acts, it is to be understood that the subject matter defined in the appended claims is not necessarily limited to the specific features or acts described above. Rather, the specific features and acts described above are disclosed as example forms of implementing the claims.

The invention claimed is:

1. A tent frame assembly comprising:

a first hub comprising a first pivotable bracket;

a second hub comprising a second pivotable bracket, the second hub being separate and spaced apart from the first hub; and at least a first frame member, a second frame member, and a third frame member, each frame member having a first end and a second end, the first ends of at least the second and third frame members being coupled to the first pivotable bracket, and the second ends of at least the second and third frame members being coupled to the second pivotable bracket, wherein:

each pivotable bracket is pivotable relative to the first and second hubs, respectively, between an extended position in which at least a portion of each of the second and third frame members are spaced apart from each other and the first frame member and a collapsed position in which the frame members are stacked adjacent each other, each pivotable bracket defining at least first, second, and third openings arranged in a V-shaped configuration, the second and third openings aligning with a corresponding opening defined through each of the second and third frame members, each of the second and third frame members are pivotably coupled to the pivotable bracket via a frame member fastener, each frame member fastener extending through the corresponding aligned second and third openings in the pivotable bracket and the respective frame member, the second frame member being pivotable about the respective frame member fastener extending through the second opening and the third frame member being pivotable about the respective frame member fastener extending through the third opening, each pivotable bracket is pivotably coupled to the respective hub via a bracket fastener, the bracket fastener extending through the first opening of the pivotable bracket and an opening defined by the hub, wherein each pivotable bracket pivots about the respective bracket fastener, and the bracket fastener does not extend through any frame members, and the first end of the first frame member is statically coupled to the first hub, and the second end of the first frame member is statically coupled to the second hub.

2. The tent frame assembly of claim 1, wherein each pivotable bracket comprises a first bracket plate and a second bracket plate, the bracket plates being spaced apart, the first bracket plate and the second bracket plate defining the at least first, second, and third openings in the pivotable bracket which align with the corresponding openings defined through the hub, the second frame member, and the third frame member, respectively.

3. The tent frame assembly of claim 1, wherein a cover is coupled to the frame members.

4. The tent frame assembly of claim 3, wherein the frame members and the cover define an interior volume in the expanded position for housing, wherein the interior volume has a height, width, and length, and wherein each of the height, width, and length is a minimum of sixty inches.

5. The tent frame assembly of claim 1, further comprising a fourth frame member and a fifth frame member, the fourth and fifth frame members each having a first end coupled to the first pivotable bracket and a second end coupled to the second pivotable bracket, wherein in the extended position, adjacent frame members are expanded to be disposed between 30° and 60° away from each other.

6. The tent frame assembly of claim 5, wherein:

each pivotable bracket further defines fourth and fifth openings arranged in the V-shaped configuration that align with a corresponding opening defined through each of the fourth and fifth frame members, respectively, and each of the fourth and fifth frame members are pivotably coupled to the pivotable bracket via a respective frame member fastener, each respective frame member fastener extends through the respective corresponding openings in the fourth and fifth frame members and the fourth and fifth openings in the pivotable bracket.

7. The tent frame assembly of claim 6, wherein:

at least one of the second, third, fourth, or fifth frame members defines a pin opening, at least one of the hubs defines a pin opening, and the tent frame assembly further comprises a removable pin, wherein the pin opening in each frame member and the corresponding pin opening in the hub are aligned in the expanded position, and the removable pin is engageable through the pin openings to prevent the frame members from pivoting relative to the hub.

8. The tent frame assembly of claim 6, wherein each pivotable bracket comprises a first bracket plate and a second bracket plate, the bracket plates being spaced apart, the first bracket plate and the second bracket plate defining the first, second, third, fourth, and fifth openings in the pivotable bracket which align with the corresponding openings defined through the hub, the second frame member, the third frame member, the fourth frame member, and the fifth frame member, respectively.

9. The tent frame assembly of claim 8, wherein each bracket plate comprises a first end that defines the first opening for receiving the respective bracket fastener and a second end, the second end of each bracket plate comprises a lower surface, a first tab extends between the lower surfaces of the second ends of the first and second bracket plates of the first pivotable bracket, and a second tab extends between the lower surface of the second ends of the first and second bracket plates of the second pivotable bracket, the tabs being adjacent the fifth frame member in the expanded position.

10. The tent frame assembly of claim 9, wherein each hub defines a pin opening, the pin opening being spaced above a portion of the hub that is adjacent the fifth frame member in the expanded position, wherein a removable pin is engageable through the pin opening and above the fifth frame member in the expanded position, and the fifth frame member is statically disposed between the removable pin and the tab in the expanded position, preventing the pivotable bracket from pivoting relative to the hub.

11. The tent frame assembly of claim 1, wherein:

each frame member comprises a first end support, a second end support, a first central support, and a second central support, wherein the first end support comprises the first end of each frame member at a proximal end thereof, and the second end support comprises the second end of each frame member at a proximal end thereof, each of the first end support and the second end support have a distal end, a first central plate is coupled to a first end of the first central support, and a second central plate is coupled to a first end of the second central support, the first and second central plates being hingedly coupled to each other, a first end plate is hingedly coupled to a second end of the first central support and is statically coupled to the distal end of the first end support, and a second end plate is hingedly coupled to a second end of the second central support and is statically coupled to the distal end of the second end support, and in a folded position, the central supports and the end supports are stacked adjacent each other, and in an unfolded position, the central supports extend away from each other and the end supports.

12. The tent frame assembly of claim 11, wherein the central supports pivot upwardly about the central plates and downwardly about the end plates in the folded position.

13. The tent frame assembly of claim 1, further comprising a fourth frame member, the fourth frame member being pivotably coupled to one of the first, second, or third frame members.

14. The tent frame assembly of claim 1, wherein for each pivotable bracket, a first wear pad is disposed between a surface of the pivotable bracket and a portion of the second frame member, and a second wear pad is disposed between the same surface of the pivotable bracket and a portion of the third frame member.

15. The tent frame assembly of claim 1, wherein each frame member has a first end support and a second end support, the first end being a proximal end of the first end support, and the second end being a proximal end of the second end support, wherein each of the first end support and the second end support comprise a first telescoping segment and a second telescoping segment, wherein the first telescoping segment slides within the second telescoping segment between a shortened position and an elongated position.

16. The tent assembly of claim 1, further comprising:

at least one wheel coupled to each of the first hub and second hub, wherein the wheels allow the tent assembly to be moved along the ground in an expanded or collapsed position.

17. The tent assembly of claim 1, further comprising a cross support member extending between the first and second hubs, the cross support member being spaced below the frame members in the expanded position.

18. The tent assembly of claim 17, wherein the cross support member has a first end and a second end, the first end extending orthogonally from the first hub, and the second end extending orthogonally from the second hub.

19. The tent assembly of claim 18, wherein the cross support member is rectangular shaped as viewed from a plan view.

20. The tent assembly of claim 17, wherein:

each pivotable bracket is pivotable relative to the respective hub within a respective plane, the cross support member comprises a first peripheral portion, a second peripheral portion, and a central pan, the first and second peripheral portions being parallelogram shaped and the center pan being rectangular, the central pan extends between and is coupled to the first and second peripheral portions, and the first and second peripheral portions are coupled to the first and second hubs, respectively, such that a central axis of each peripheral portion is transverse to the respective plane in which each bracket pivots and a central axis of the central pan.

21. The tent assembly of claim 20, wherein the first peripheral portion, the second peripheral portion, and the central pan are integrally formed.

22. The tent assembly of claim 20, wherein the first peripheral portion, the second peripheral portion, and the central pan are separately formed and coupled together.

23. The tent assembly of claim 1, further comprising a stabilization mechanism coupled to at least one of the frame members and/or the first and second hubs.

* * * * *